US006472930B1

(12) United States Patent
Morimoto et al.

(10) Patent No.: US 6,472,930 B1
(45) **Date of Patent: *Oct. 29, 2002**

(54) SEMICONDUCTOR INTEGRATED CIRCUIT DEVICE

(75) Inventors: Yasuo Morimoto; Hiroyuki Kono; Takahiro Miki, all of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/177,503

(22) Filed: Oct. 23, 1998

(30) Foreign Application Priority Data

May 25, 1998 (JP) ..... 10-142943

(51) Int. Cl.[7] ..... G05F 1/10
(52) U.S. Cl. ..... 327/543; 327/545; 327/427
(58) Field of Search ..... 327/538, 540, 327/541, 542, 543, 378, 427, 431, 545, 546; 323/312, 313

(56) References Cited

U.S. PATENT DOCUMENTS 4,533,842 A * 8/1985 Yang et al. ..... 323/313
5,281,873 A * 1/1994 Seki ..... 327/544
5,309,036 A * 5/1994 Yang et al. ..... 327/427
5,309,044 A * 5/1994 Wang ..... 323/312
5,381,057 A * 1/1995 Kuroda et al. ..... 327/540
5,471,169 A * 11/1995 Dendinger ..... 327/66
5,552,724 A * 9/1996 Scott ..... 327/542
5,945,851 A * 8/1999 Tu et al. ..... 327/65

OTHER PUBLICATIONS

Hiroyuki Kohno et al., "A 350–MS/s 3.3–V 8–bit CMOS D/A Converter Using a Delayed Driving Scheme", IEICE Transactions on Fundamentals of Electronics, Communications and Computer Sciences, vol. E80–A, No. 2, Feb. 1997, pp. 334–338.

* cited by examiner

*Primary Examiner*—Timothy P. Callahan
*Assistant Examiner*—An T. Luu
(74) *Attorney, Agent, or Firm*—Oblon, Spivak, McClelland, Maier & Neustadt, P.C.

(57) ABSTRACT

A current generator (CG) is composed of a constant-current-source transistor M1, and transistors (M2, M3). On receipt of control signals (VG2, VG3) respectively from a driver circuit (not shown), the transistors (M2, M3) complementarily operate to function as current switches. Then, damping resistance (R3) is provided between the drain electrode of the transistor (M3) and an output terminal ($\overline{IT}$). The output terminal ($\overline{IT}$) is connected to a ground (GND), while an output terminal (IT) is grounded via an external terminal (R2). Such a structure allows a semiconductor integrated circuit device to reduce its output ringing and further to suppress imperfections resulting from the adoption of the structure to reduce the ringing.

7 Claims, 28 Drawing Sheets

500

SEMICONDUCTOR INTEGRATED CIRCUIT DEVICE

BACKGROUND OF THE INVENTION

1. Field of the Invention

The present invention relates to a semiconductor integrated circuit device, especially to a current generator preventing its output ringing.

2. Background of the Invention

A converter for converting a signal from digital to analog (hereinafter referred to as "D/A converters"), especially a current output type D/A converter, is an aggregate of current generators each including $2^{N-1}$ constant current sources for N input digital bits and outputting current corresponding to the number of input digital bits. In the following, the structure of a typical D/A converter and problems thereof will be described.

First, we will describe the structure of a typical D/A converter 90 with reference to FIG. 30. The D/A converter 90 is mainly composed of a plurality of current source cells CL, and moreover includes a decoder/clock buffer portion DB connected to the current source cells CL, a bias circuit BC, and so on. Each of the current source cells CL has two output nodes I1 and I2 connected to output terminals IT and $\overline{IT}$, respectively. The output terminal IT is grounded via an external resistance R2, and the output terminal $\overline{IT}$ is directly grounded.

Next, we will describe the structure of the current source cell CL that is composed of a current generator CG and a driver circuit DC.

The current generator CG is composed of P-channel MOSFETs, including a constant-current-source transistor M1 connected at its source electrode to a power supply VDD, for generating constant current in response to a bias signal BS applied from the bias circuit BC, and transistors M2 and M3 each connected at its source electrode to a drain electrode of the transistor M1. The drain electrodes of the transistors M2 and M3 correspond to the output nodes I1 and I2, respectively. On receipt of control signals from the driver circuit DC, the transistors M2 and M3 complementarily operate to function as current switches (first and second switch means).

The driver circuit DC is composed of inverter circuits IV2 and IV3 connected at their outputs to the transistors M2 and M3, respectively. The inverter circuit IV2 comprises a P-channel transistor M6 and an N-channel transistor M7 connected in series between the power supply VDD and the ground, and each receiving a selection signal SL at its gate electrode. The inverter circuit IV3 comprises a P-channel transistor M8 and an N-channel transistor M9 connected in series between the power supply VDD and the ground, and each receiving a selection signal $\overline{SL}$ at its gate electrode. The selection signals SL and $\overline{SL}$ are applied from a decoder of the decoder/clock buffer portion DB.

The current-output type D/A converter 90 with such a structure has faced a problem that recent high speed in D/A conversion increases variations in output current per unit of time, thereby causing ringing in the output waveform.

FIG. 31 shows such an output waveform with ringing. The horizontal axis indicates time, and the vertical axis indicates an output voltage. As shown, ringing mostly occurs on the top portion that is originally supposed to be flat and near the falling edge of the output waveform. As a fluctuation in the output waveform, the ringing must be reduced at any cost to secure the quality of the analog output.

Referring to FIG. 32, we will now describe the cause of the ringing. FIG. 32 shows inductance components and capacitive components, which are parasitic on the D/A converter 90 in FIG. 30, as inductance and capacitance, respectively.

As shown in FIG. 32, there are parasitic inductance L1 between the power supply VDD and the source electrode of the transistor M1 (connected to a power terminal PT), parasitic capacitance C3 between the source electrode of the transistor M1 and the drain electrode of the transistor M2, parasitic capacitance C4 between the source electrode of the transistor M1 and the drain electrode of the transistor M3, parasitic capacitance C5 between the drain electrode of the transistor M2 and a substrate SS, and parasitic capacitance C6 between the drain electrode of the transistor M3 and the substrate SS.

Further, there are parasitic inductance L2 between the output terminal IT and the external resistance R2, parasitic inductance L3 between the output terminal $\overline{IT}$ and the ground GND, and parasitic capacitance C2 in parallel with the external terminal R2.

The ringing is caused by a resonance of the parasitic inductance and the parasitic capacitance. Especially, it is considerably enlarged in the presence of the circuit that includes only the parasitic inductance and the parasitic capacitance on its path from the power supply VDD to the ground GND, or in the presence of a loop circuit that is composed only of the parasitic inductance and the parasitic capacitance.

As an example of the circuit that includes only the parasitic inductance and the parasitic capacitance on its path from the power supply VDD to the ground GND, a first LC circuit PS1 is shown in bold type in FIG. 33. This circuit is composed of the power supply VDD, the parasitic inductance L1, the parasitic capacitance C4, the parasitic inductance L3, and the ground GND. FIG. 33, given for explanation of this circuit, is basically the same as FIG. 32.

As another example of such a circuit, a second LC circuit PS2 is shown in bold type in FIG. 34. This circuit is composed of the power supply VDD, the parasitic inductance L1, the parasitic capacitance C3, the parasitic inductance L2, the parasitic capacitance C2, and the ground GND. FIG. 34, given for explanation of this circuit, is basically the same as FIG. 32.

As an example of the loop circuit that is composed only of the parasitic inductance and the parasitic capacitance, third and fourth circuits PS3 and PS4 are shown in bold type in FIG. 35. The third circuit PS3 is composed of the substrate SS, the parasitic capacitance C5, the parasitic inductance L2, the parasitic capacitance C2, and the ground GND, and the fourth circuit PS4 is composed of the substrate SS, the parasitic capacitance C6, the parasitic inductance L3, and the ground GND. If a P-type semiconductor substrate is used, these two circuits are looped because the substrate potential becomes the ground potential. FIG. 35, given for explanation of the third and the fourth circuits, is basically the same as FIG. 32.

This ringing problem has not been characteristic of the current generator in the D/A converter, but common to the semiconductor integrated circuit devices with similar structures.

SUMMARY OF THE INVENTION

A first aspect of the present invention is directed to a semiconductor integrated circuit device comprising: a constant current source connected to a first power supply via a power terminal; first and second current switches connected to the output of the constant current source in parallel with each other, for outputting the output of the constant current source complementarily as first and second outputs respectively on the basis of first and second control signals complementarily applied from driving means; first and second terminals receiving the first and the second outputs, respectively; a first resistive element provided on at least either one of a first path connecting the first current switch and the first terminal and a second path connecting the second current switch and the second terminal.

Preferably, according to a second aspect of the present invention, the first terminal outputs the first output to the outside as the output of the semiconductor integrated circuit device; the second terminal connects the second output to a second power supply; and the first resistive element is provided on the second path.

Preferably, according to a third aspect of the present invention, the first terminal outputs the first output to the outside as the output of the semiconductor integrated circuit device; the second terminal connects the second output to a second power supply; and the first resistive element includes a first element provided on the first path and a second element provided on the second path.

Preferably, according to a fourth aspect of the present invention, the constant current source, the first current switch, and the second current switch are first to third transistors of a first conductivity type, respectively. The first transistor is connected at its first main electrode to the power terminal and at its second main electrode to respective first main electrodes of the second and the third transistors, and the second transistor and the third transistor are connected at their second main electrodes to the first path and the second path, respectively. The driving means comprises: a first inverter circuit having a fourth transistor of the first conductivity type that is connected at its first main electrode to the first power supply, and a fifth transistor of a second conductivity type that is connected at its first main electrode to the second power supply and at its second main electrode to a second main electrode of the fourth transistor. The first inverter circuit inverts a first signal that is applied at respective control electrodes of the fourth and the fifth transistors, and outputs the inverted first signal as the first control signal from a connected portion between the second main electrodes of the fourth and the fifth transistors, the connected portion being an output portion. The driving means further comprises a second inverter circuit having a sixth transistor of the first conductivity type that is connected at its first main electrode to the first power supply, and a seventh transistor of the second conductivity type that is connected at its first main electrode to the second power supply and at its second main electrode to a second main electrode of the sixth transistor. The second inverter circuit inverts a second signal that is applied at respective control electrodes of the sixth and the seventh transistors, and outputs the inverted second signal as the second control signal from a connected portion between the second main electrodes of the sixth and the seventh transistors, the connected portion being an output portion. The driving means further comprises a second resistive element electrically connected between the output portions of the first and the second inverter circuits.

Preferably, according to a fifth aspect of the present invention, the second resistive element is a resistance.

Preferably, according to a sixth aspect of the present invention, the second resistive element is composed of: an eighth transistor having a first main electrode connected to the first inverter circuit, a second main electrode connected to the second inverter circuit, and a control electrode having a diode connection; and a ninth transistor having a first main electrode connected to the second inverter circuit, a second main electrode connected to the first inverter circuit, and a control electrode having a diode connection.

Preferably, according to a seventh aspect of the present invention, the driving means further comprises: first cutoff means provided between the second main electrode of the eighth transistor and the output portion of the second inverter circuit, the first cutoff means receiving a cutoff signal and cutting off a path that electrically connects the second main electrode of the eighth transistor and the output portion of the second inverter circuit; and second cutoff means provided between the second main electrode of the ninth transistor and the output portion of the first inverter circuit, the second cutoff means receiving the cutoff signal and cutting off a path that electrically connects the second main electrode of the ninth transistor and the output portion of the first inverter circuit.

Preferably, according to an eighth aspect of the present invention, the first cutoff means and the second cutoff means are tenth and eleventh transistors, respectively; and the cutoff signal is applied to respective control electrodes of the tenth and the eleventh transistors.

Preferably, according to a ninth aspect of the present invention, the constant current source, the first current switch, and the second current switch are first to third transistors of a first conductivity type, respectively. The first transistor is connected at its first main electrode to the power terminal and at its second main electrode to respective first main electrodes of the second and the third transistors, and the second transistor and the third transistor are connected at their second electrodes to the first path and the second path, respectively. The driving means includes an inverter circuit having a fourth transistor of the first conductivity type that is connected at its first main electrode to the first power supply, a fifth transistor of a second conductivity type that is connected at its first main electrode to the second power supply and at its second main electrode to a second main electrode of the fourth transistor, and a first resistance provided between the first and the second main electrodes of the fourth transistor. The inverter circuit inverts a signal that is applied at respective control electrodes of the fourth and the fifth transistors, and outputs the inverted signal as the first or second control signal from a connected portion between the second main electrodes of the fourth and the fifth transistors, the connected portion being an output portion.

Preferably, according to a tenth aspect of the present invention, the constant current source, the first current switch, and the second current switch are first to third transistors of a first conductivity type, respectively. The first transistor is connected at its first main electrode to the power terminal and at its second main electrode to respective first main electrodes of the second and the third transistors, and the second transistor and the third transistor are connected at their second main electrodes to the first path and the second path, respectively. The driving means includes an inverter circuit having a fourth transistor of the first conductivity type that is connected at its first main electrode to the first power supply, a fifth transistor of a second conductivity type that is connected at its first main electrode to the second power supply and at its second main electrode to a second main electrode of the fourth transistor, a first resistance provided between the first and the second main electrodes of the fourth transistor, and a second resistance provided between the first and the second main electrodes of the fifth transistor. The inverter circuit inverts a signal that is applied at respective control electrodes of the fourth and the fifth transistors, and outputs the inverted signal as the first or second control signal from a connected portion between the second main electrodes of the fourth and the fifth transistors, the connected portion being an output portion.

Preferably, according to an eleventh aspect of the present invention, the power terminal, a power path connecting the constant current source and the power terminal, the first terminal, the first path, the second terminal, the second path, and the first resistive element are provided on an well region of a second conductivity type that is formed in the surface of a semiconductor substrate of a first conductivity type and is electrically connected to the first power supply.

Preferably, according to a twelfth aspect of the present invention, the well region is electrically connected to the first power supply via a third resistive element.

Preferably, according to a thirteenth aspect of the present invention, the first path and the second path are provided on each side of the power path in parallel with each other.

A fourteenth aspect of the present invention is directed to a semiconductor integrated circuit device formed on a semiconductor substrate of a first conductivity type. The device comprises: a path provided in a region except an element-forming region where an element to specify the operation of the semiconductor integrated circuit device is formed. The path is formed of a conductive layer electrically connected to the element-forming region. Further, the path is provided on a well region of a second conductivity type that is formed in the surface of the semiconductor substrate of the first conductivity type and is electrically connected to an operating power of the semiconductor integrated circuit device.

Preferably, according to a fifteenth aspect of the present invention, the well region is electrically connected to the operating power via a resistive element.

A sixteenth aspect of the present invention is directed to a semiconductor integrated circuit device comprising: a current generator including a transistor for outputting current in response to a bias signal applied at its control signal, and a resistance connected at its one end to the control electrode of the transistor; bias-signal supply means for supplying the bias signal via a bias-signal line connected to the other end of the resistance; and a capacitor provided between the bias-signal line and a predetermined power supply. In the device, a line width of the resistance is set wide enough to be resistant to a surge voltage to be applied from the predetermined power supply side via the capacitor.

In the semiconductor integrated circuit of the first aspect, the first resistive element is provided on at least either one of the first and the second paths, which eliminates at least either one of two paths each composed only of the parasitic inductance and the parasitic capacitance that are parasitic on the current paths from the first power supply through the constant current source and the first or second switch to the first or second terminal. This achieves damping of oscillation due to a resonance of the parasitic inductance and the parasitic capacitance.

In the semiconductor integrated circuit device of the second aspect, the first resistive element is provided on the second path, which eliminates a path composed only of the parasitic inductance and the parasitic capacitance that are parasitic on the current path from the first power supply through the constant current source, the second current switch and the second terminal to the second power supply. This achieves damping of oscillation due to the resonance of the parasitic inductance and the parasitic capacitance on that path.

In the semiconductor integrated circuit device of the third aspect, the first element is provided on the first path, which eliminates a path composed only of the parasitic inductance and the parasitic capacitance that are parasitic on the current path from the first power supply through the constant current source and the first current switch to the first terminal. Further, the second element is provided on the second path, which eliminates a path composed only of the parasitic inductance and the parasitic capacitance that are parasitic on the current path from the first power supply through the constant current source, the second current switch, and the second terminal to the second power supply. Thus, the device achieves damping of oscillation due to the resonance of the parasitic inductance and the parasitic resistance.

In the semiconductor integrated circuit device of the fourth aspect, when the first signal is applied to turn on the fourth transistor, for example, a current path is formed from the first power supply through the fourth transistor, the second resistive element and the seventh transistor to the second power supply, and the second control signal whose reference potential is closer to the potential of the first power supply than the potential of the second power supply, is applied to the third transistor. This resolves the problem that, when first resistive element is provided on the second path, potential difference between the second main electrode of the third transistor and the second control signal is reduced so that the third transistor does not operate in the saturation region. Similarly, operating imperfection of the second transistor, occurring when the first resistive element is provided on the first path, can be eliminated.

In the semiconductor integrated circuit device of the fifth aspect, the second resistive element is readily formable because it is composed of the resistance.

In the semiconductor integrated circuit device of the sixth aspect, it is possible to obtain on-state resistance of the eighth and the ninth transistors having a diode connection, so that the equivalent resistance value is obtained with smaller area than in the device having the second resistive element in the form of resistance. This achieves downsizing of the device.

In the semiconductor integrated circuit device of the seventh aspect, the current flowing through the second resistive element can be cut off optionally by the first and the second cutoff means on the basis of the cutoff signal. This prevents a constant current flow to the second resistive element, thereby reducing wasteful current consumption.

In the semiconductor integrated circuit device of the eighth aspect, the first cutoff means and the second cutoff means are composed of the tenth and the eleventh transistors, respectively. Thus, when the current flow is not cut off, more on-state resistance can be obtained in addition to the on-state resistance of the eighth and the ninth transistors.

In the semiconductor integrated circuit device of the ninth aspect, when the first signal is applied to turn on the fifth transistor, current flows from the first power supply to the first resistance, and the first or second control signal whose reference potential is closer to the potential of the first power supply than that of the second power supply, is applied from the output end of the inverter circuit. This resolves the problem that, when the inverter circuit is connected to the control electrode of the third transistor by the first resistive element provided on the second path, potential difference between the second main electrode of the third transistor and the second control signal is reduced so that the third transistor does not operate in the saturation region. Similarly, operating imperfection of the second transistor, occurring when the inverter circuit is connected to the control electrode of the second transistor by the first resistive element on the first path, can be eliminated.

In the semiconductor integrated circuit device of the tenth aspect, when the first signal is applied to turn on the fifth transistor, current flows from the first power supply to the first resistance, and the first or second control signal whose reference potential is closer to the potential of the first power supply than that of the second power supply, is applied from the output portion of the inverter circuit. On the contrary, when the first signal is applied to turn off the fifth transistor, current flows from the second power supply to the second resistance, and the first or second control signal whose reference potential is closer to the potential of the second power supply than that of the first power supply, is applied from the output portion of the inverter circuit. This reduces variations in the first or second control signal, thereby reducing fluctuations in the outputs of the second and the third transistors.

In the semiconductor integrated circuit device of the eleventh aspect, the power terminal, the power path connecting the constant current source and the power terminal, the first terminal, the first path, the second terminal, the second path, and the first resistive element are provided above the well region of the second conductivity type that is electrically connected to the first power supply. Thus, the parasitic capacitance between those terminals or paths and the well region, and the parasitic capacitance between the well region and the semiconductor substrate are connected in series. This reduces the parasitic capacitance, thereby achieving damping of oscillation due to the resonance of the parasitic inductance and the parasitic capacitance.

In the semiconductor integrated circuit device of the twelfth aspect, the well region that is electrically connected to the first power supply via the third resistive element achieves further damping of oscillation due to the resonance of the parasitic inductance and the parasitic capacitance.

In the semiconductor integrated circuit device of the thirteenth aspect, the first path and the second path are provided on each side of the power path in parallel with each other, so that the flow of current through one terminal is opposite to that through the adjacent terminals. This allows mutual inductance between the adjacent terminals to reduce the influence of self inductance at each terminal.

In the semiconductor integrated circuit device of the fourteenth aspect, the parasitic capacitance between the conductive layer and the well region, and the parasitic capacitance between the well region and the semiconductor substrate are connected in series, because the path formed of the conductive layer is provided above the well region of the second conductivity type that is electrically connected to the operating power of the semiconductor integrated circuit device. This reduces the parasitic capacitance, thereby achieving damping of oscillation due to the resonance of the parasitic inductance and the parasitic capacitance.

In the semiconductor integrated circuit device of the fifteenth aspect, the electrical connection of the well region and the operating power via the resistive element allows further damping of oscillation due to the resonance of the parasitic inductance and the parasitic capacitance.

The semiconductor integrated circuit device of the sixteenth aspect can prevent damage to the current-source transistor by the application of the surge voltage. Further, when including a plurality of current generators, the device can prevent propagation of potential fluctuations at the control electrode of the current-source transistor in one current generator to other current-source transistors in other current generators, as well as crosstalk between the current generators.

Thus, an object of the present invention is to provide the semiconductor integrated circuit device reducing its output ringing and preventing imperfections due to the application of the structure to reduce the ringing.

These and other objects, features, aspects and advantages of the present invention will become more apparent from the following detailed description of the present invention when taken in conjunction with the accompanying drawings.

DESCRIPTION OF THE PREFERRED EMBODIMENTS

In first and second preferred embodiments of the present invention, we will first describe the structure to reduce ringing due to the parasitic inductance and the parasitic capacitance on the path from the power supply to the ground.

1. First Preferred Embodiment 1-1. Device Structure

Figure 1:
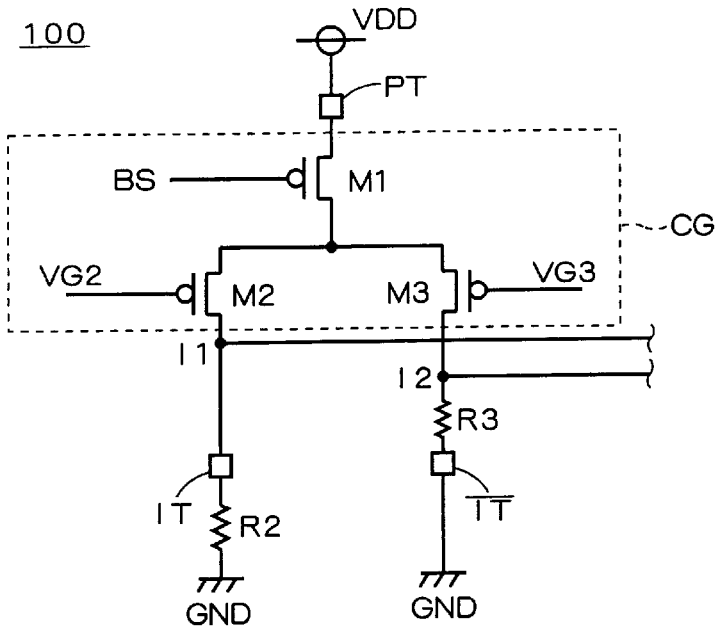
FIG. 1 shows a partial structure of a D/A converter according to a first preferred embodiment of the present invention.

FIG. 1 shows a partial structure of a converter 100 for converting a signal from digital to analog (hereinafter referred to as a "D/A converter") according to the first preferred embodiment of the present invention.

The D/A converter, especially a current output type D/A converter, is an aggregate of current generators each outputting current corresponding to the number of input digital bits. Such a D/A converter comprises a plurality of current generators CG shown in FIG. 1.

As shown in FIG. 1, the current generator CG is composed of P-channel MOSFETs, including a constant-current-source transistor M1 connected at its source electrode to the power supply VDD via a power terminal PT, for generating constant current in response to a bias signal BS applied from a bias circuit (not shown), and transistors M2 and M3 each connected at its source electrode to a drain electrode of the transistor M1. On receipt of control signals VG2 and VG3 respectively from a driver circuit (not shown), the transistors M2 and M3 complementarily operate to function as current switches (first and second current switches).

Then, dumping resistance R3 is provided on a (second) path between a drain electrode of the transistor M3 and an output terminal $\overline{\text{IT}}$ that is connected to a ground GND. An output terminal IT is also grounded via external resistance R2.

Further, output nodes I1 and I2 of the current generator CG, namely, the drain electrodes of the transistors M2 and M3, are connected to output nodes I1 and I2 of the other current generators CG (not shown), respectively. The overall structure of the D/A converter 100 will be described later, referring to the drawings.

1-2. Characteristic Function and Effect

Figure 33:
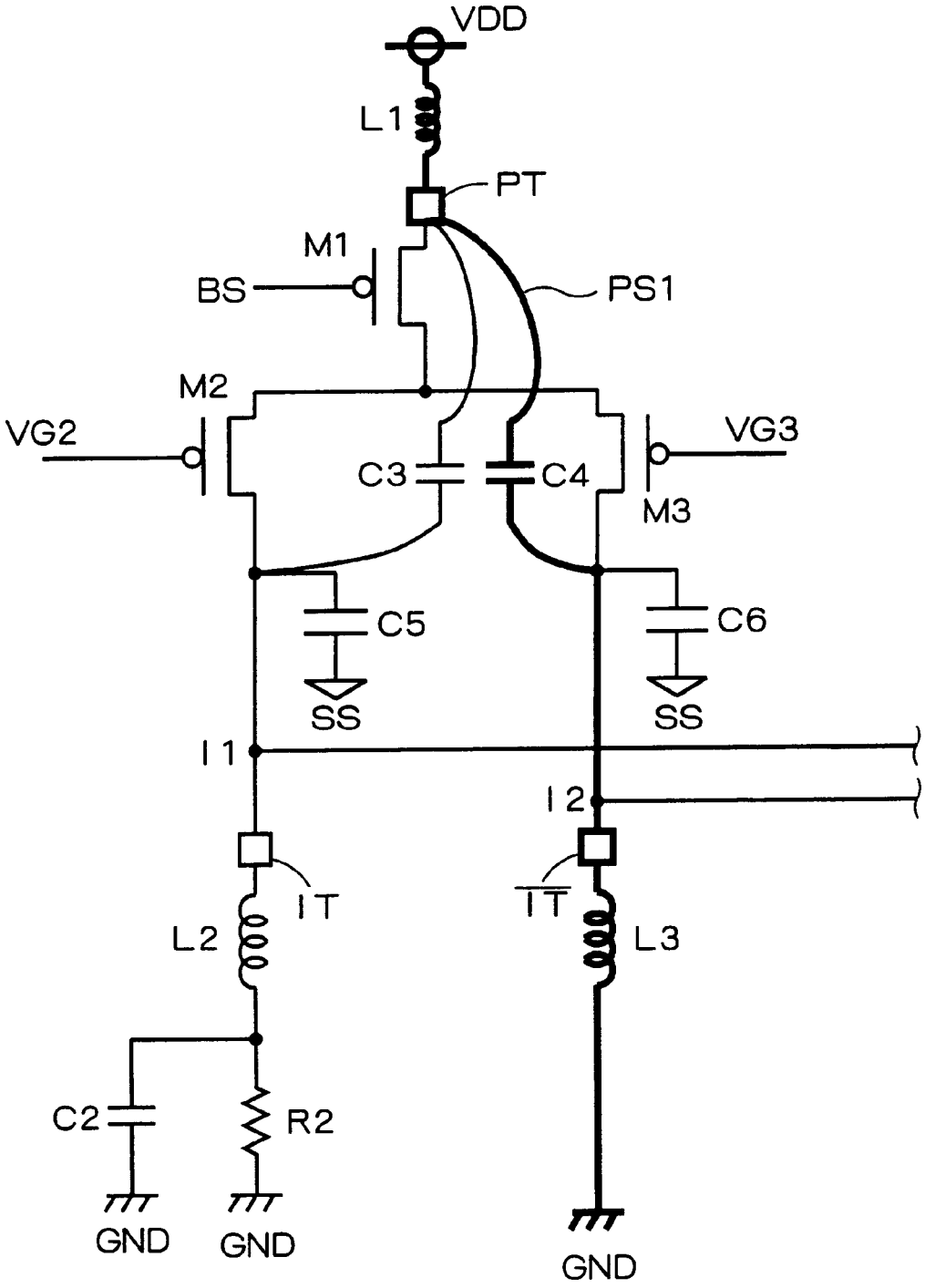
FIG. 33 (BACKGROUND ART)

The dumping resistance R3 provided between the drain electrode of the transistor M3 and the output terminal $\overline{\text{IT}}$ permits reduction in the ringing due to the parasitic inductance and the parasitic capacitance both existing in the first LC circuit PS1 shown in FIG. 33.

In the following, we will describe how to reduce the ringing, referring to FIGS. 33 and 1. If the dumping resistance R3 is provided in the first LC circuit PS1 shown in bold type in FIG. 33, namely, the circuit composed of the power supply VDD, the parasitic inductance L1, the parasitic capacitance C4, the parasitic inductance L3, and the ground GND, a loop circuit is formed via the ground because these components are substantially connected in series. This loop circuit satisfies the following equation (1) that is obtained by the Kirchhoff's theory of voltage:

$$E + Ri + L\frac{di}{dt} + \frac{1}{c}\int_0^t i\,dt = 0 \tag{1}$$

Where E is the power supply VDD; R is the dumping resistance R3; L is the total of the parasitic inductance L1 and L3; and C is the parasitic capacitance C4.

Differentiate the equation (1) by time t, we obtain the equation (2):

$$L\frac{d^2 i}{dt^2} + R\frac{di}{dt} + \frac{1}{C}i = 0 \tag{2}$$

Then, solve the equation (2) for current i, we obtain the equation (3):

$$i = i_0 e^{-\frac{Rt}{2L}}\ (\sin\omega t + \cos\omega t) + k \tag{3}$$

As shown in the equation (3), $$e^{-\frac{Rt}{2L}}$$

causes oscillation due to the resonance of C and L to damp. This indicates that the ringing will damp in the presence of R, namely, the damping resistance R3.

2. Second Preferred Embodiment 2-1. Device Structure

Figure 2:
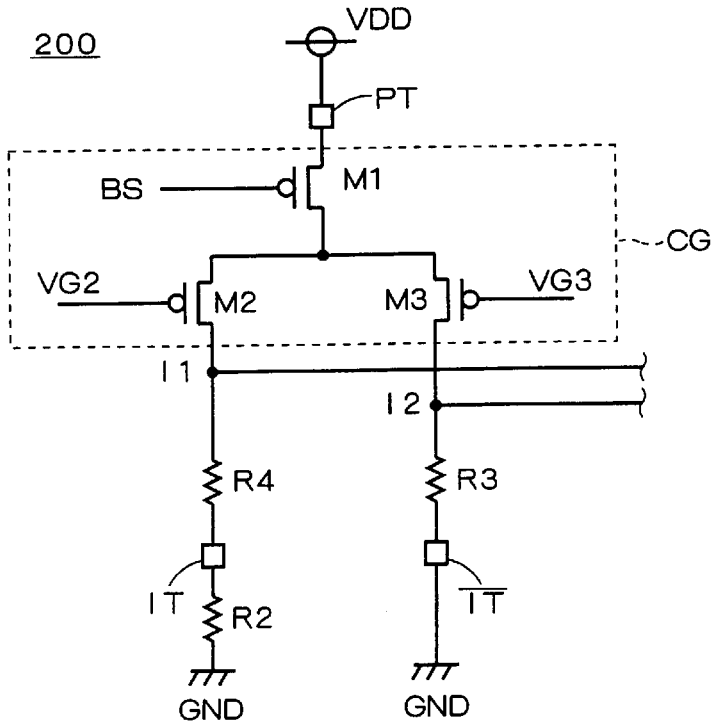
FIG. 2 shows a partial structure of a D/A converter according to a second preferred embodiment of the present invention.

FIG. 2 shows a partial structure of a D/A converter 200 according to a second preferred embodiment of the present invention. In FIG. 2, similar components to those of the D/A converter 100 in FIG. 1 are denoted by the same reference numerals and characters to simplify the description.

In the current generator CG, as shown, damping resistance R3 and R4 are provided on the second path between the drain electrode of the transistor M3 and the output terminal $\overline{\text{IT}}$ and on the first path between the drain electrode of the transistor M2 and the output terminal IT, respectively. The output terminal $\overline{\text{IT}}$ is connected to the ground GND, while the output terminal IT is grounded via the external resistance R2.

2-2. Characteristic Function and Effect

Figure 34:
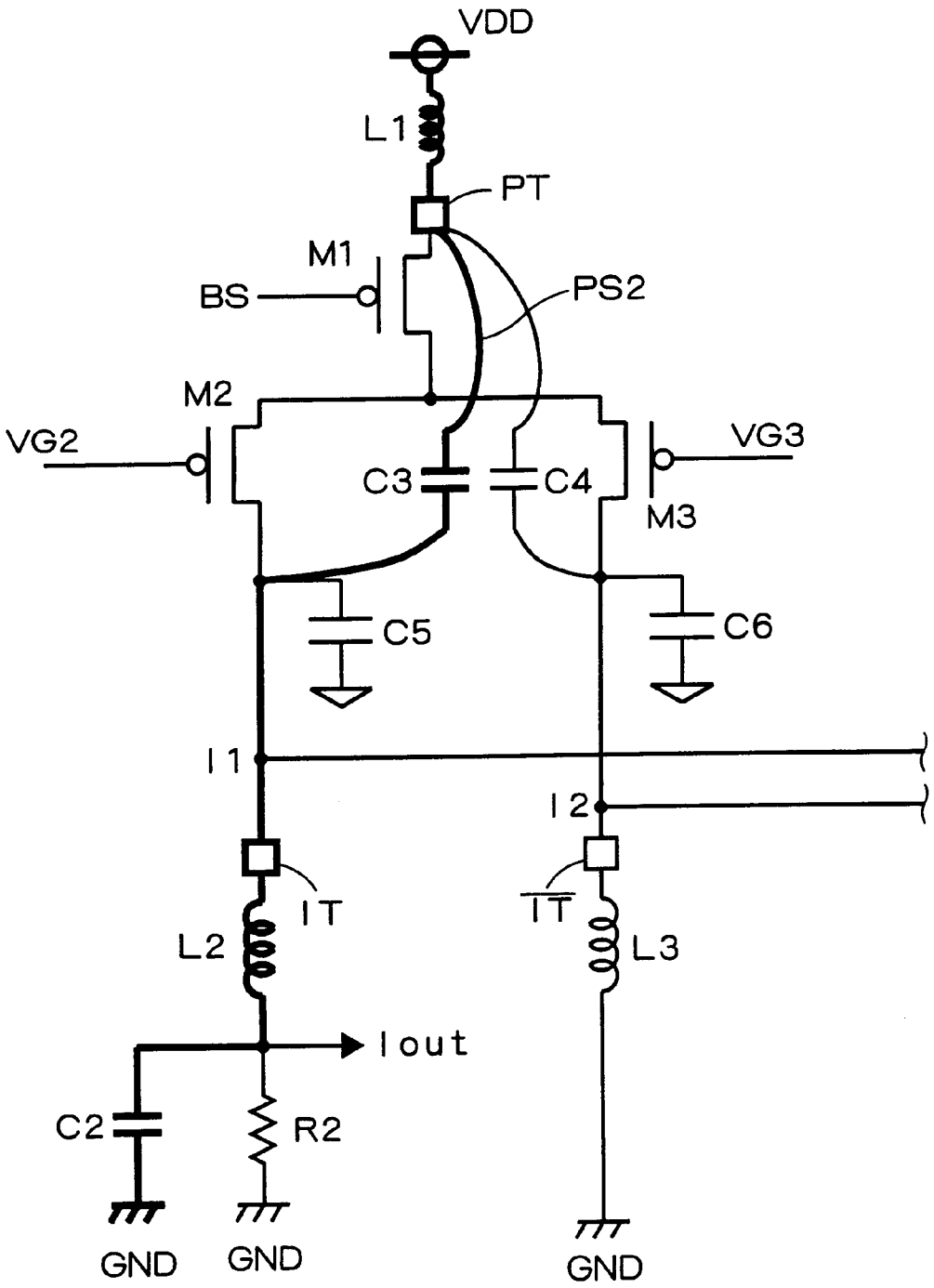
FIG. 34 (BACKGROUND ART)
Figure 35:
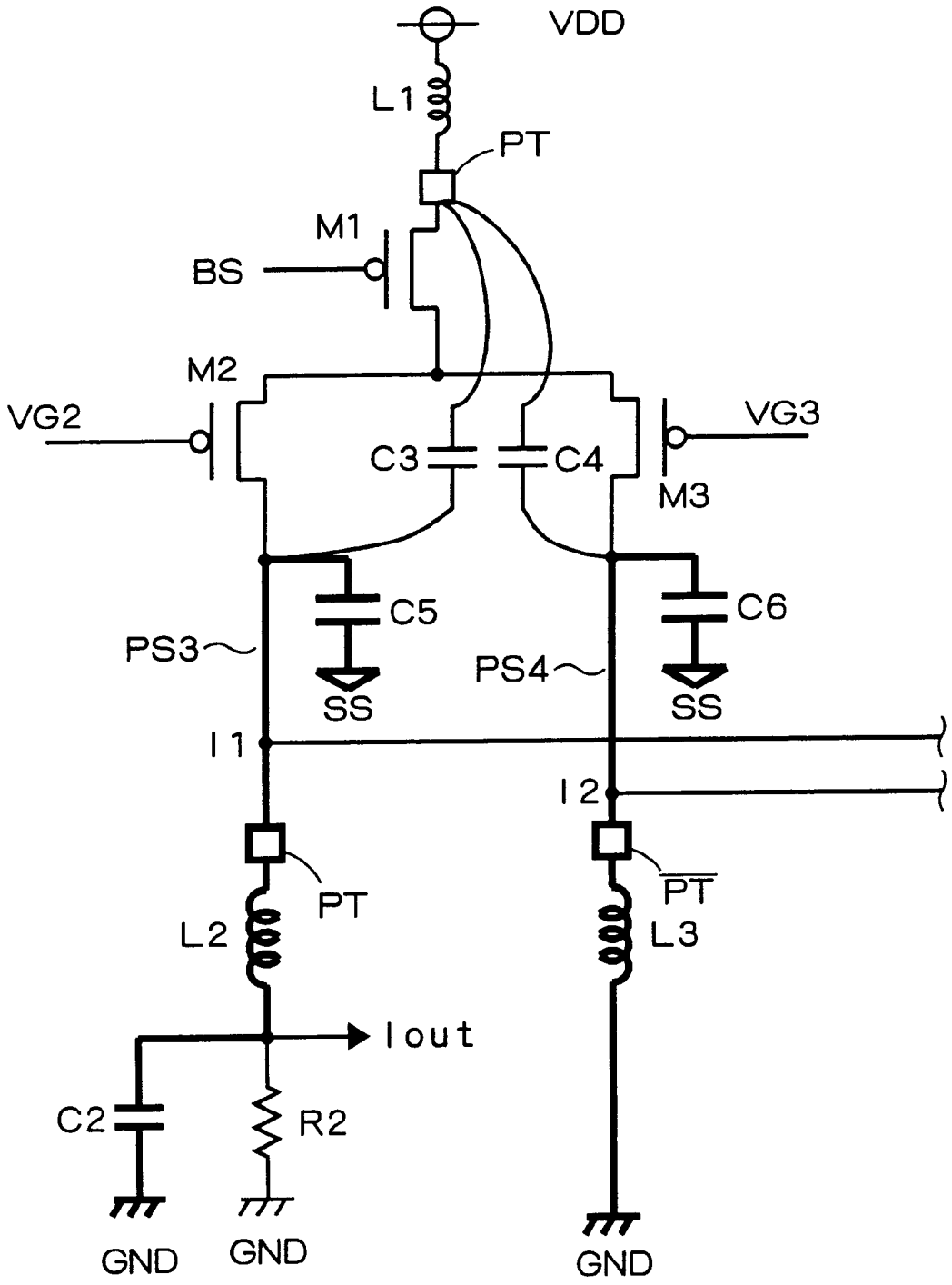
FIG. 35 (BACKGROUND ART)

The damping resistance R3 and R4 provided in this fashion permits reduction not only in the ringing due to the parasitic inductance and the parasitic capacitance in the first LC circuit PS1 shown in FIG. 33, but also in the ringing due to the parasitic inductance and the parasitic capacitance in the second LC circuit PS2 shown in FIG. 34.

When the damping resistance R4 is provided in the second LC circuit PS2 shown in bold type in FIG. 34, namely, the circuit composed of the power supply VDD, the parasitic inductance L1, the parasitic capacitance C3, the parasitic inductance L2, the parasitic capacitance C2, and the ground GND, a loop circuit is formed via the ground because those components are substantially connected in series. However, as previously described using the equations (1) to (3), the damping resistance R4 permits damping of oscillation due to the resonance of the parasitic inductance and the parasitic capacitance. This damps the ringing.

In the second LC circuit PS2 shown in FIG. 34, the resistance R2 is provided in parallel with the parasitic capacitance C2 so that current mostly flows into the resistance R2. In this case, the effect of damping the ringing by the damping resistance R4 is not noticeable as compared with the effect obtained by locating the damping resistance R3 on the path between the drain electrode of the transistor M3 and the output terminal $\overline{IT}$. However, the effect is still great enough to be observed from the output waveform of the output terminal IT. Thus, even with no damping resistance R3, only the damping resistance R4 can prevent the output ringing.

2-3. First Modification

The application of the present invention is not limited to the current generator CG composed of the P channel MOSFETs as previously described in the first and the second preferred embodiments. The invention is also applicable to a D/A converter with the current generator composed of N-channel MOSFETs.

Figure 3:
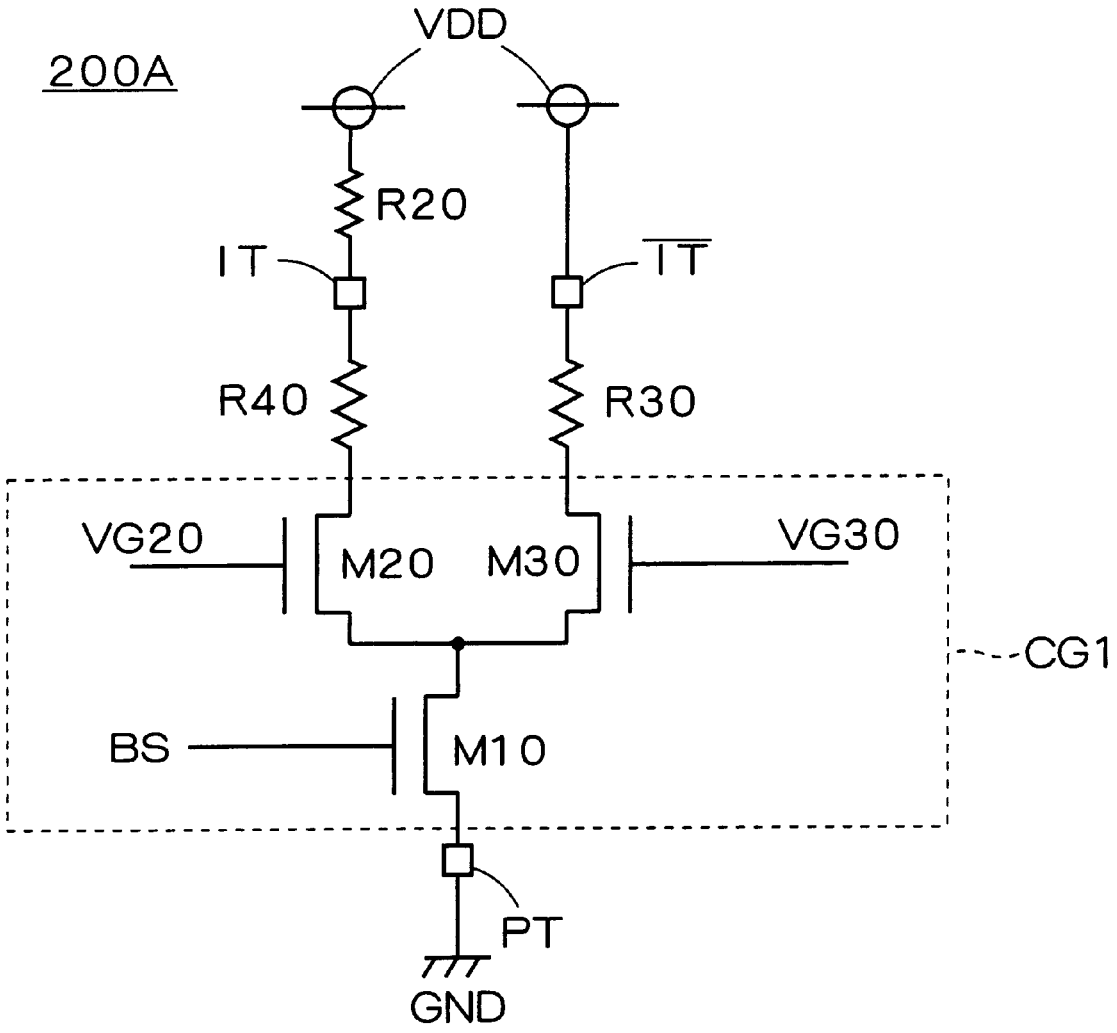
FIG. 3 shows an example of the application of the second preferred embodiment.

FIG. 3 shows a D/A converter 200 A with a current generator CG1 composed of N-channel MOSFETs. As shown, the current generator CG1 is composed of a constant-current-source transistor M10 connected at its source electrode to the ground GND via the source terminal PT, for generating constant current on receipt of the bias signal BS supplied from the bias circuit (not shown), and transistors M20 and M30 each connected at its source electrode to the drain electrode of the transistor M10. On receipt of control signals VG20 and VG30 respectively from a driver circuit (not shown), the transistors M20 and M30 complementarily operate to function as current switches (first and second current switches).

Further, damping resistance R30 is provided on a second path between the drain electrode of the transistor M30 and the output terminal $\overline{IT}$, and damping resistance R40 is provided on a first path between the drain electrode of the transistor M20 and the output terminal IT. The output terminal $\overline{IT}$ is directly connected to the power supply VDD, while the output terminal IT is connected to the power supply VDD via an external resistance R20. The D/A converter 200A with such a structure can prevent the output ringing as well.

2-4. Second Modification

While including only one constant-current-source transistor in the first preferred embodiment and in the first modification of the second preferred embodiment, the current generator in the D/A converter may include a plurality of constant-current-source transistors.

Figure 4:
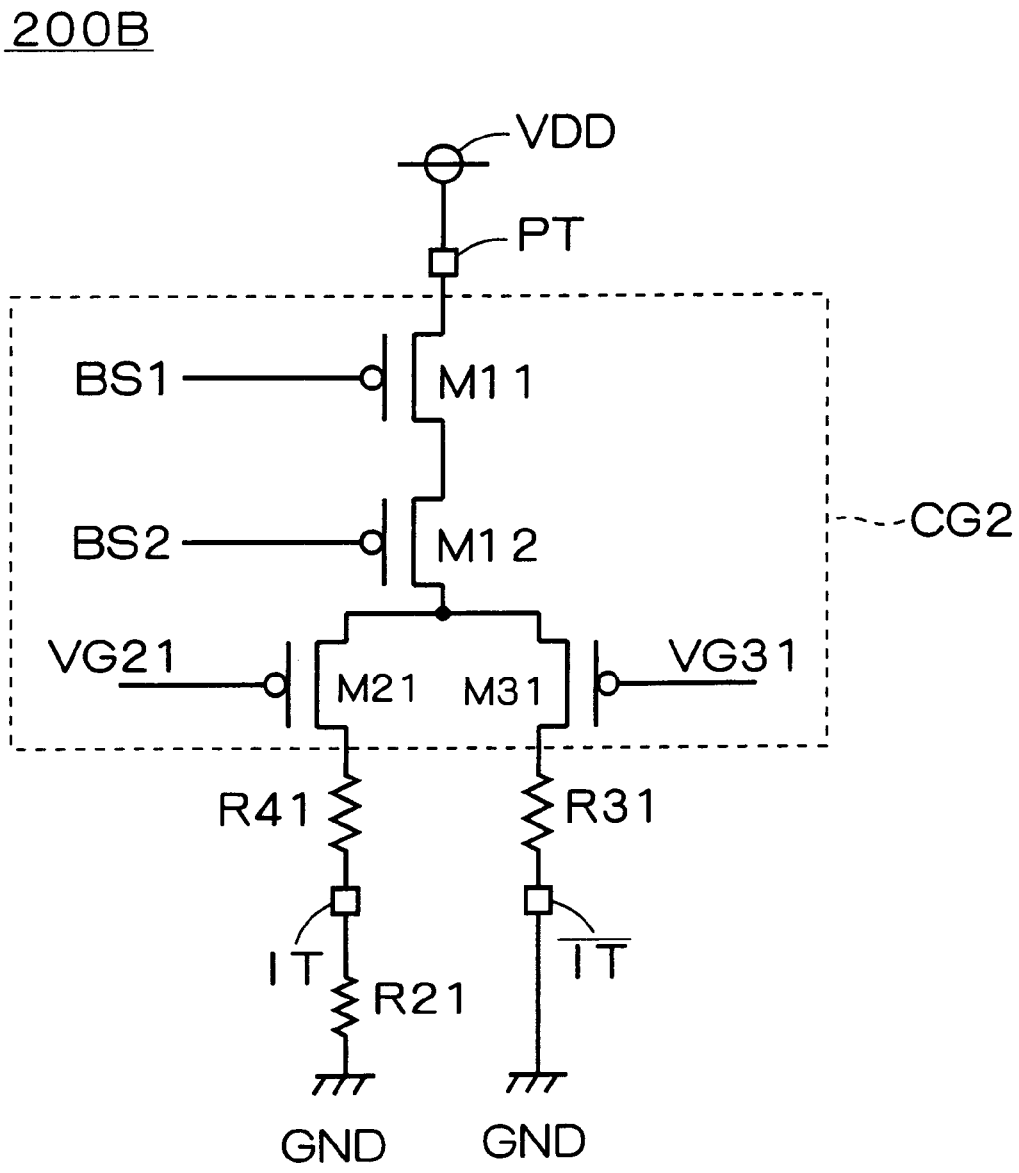
FIG. 4 shows another example of the application of the second preferred embodiment.

FIG. 4 shows a D/A converter 200B with a current generator CG2 including a plurality of constant-current-source transistors. As shown, the current generator CG2 is composed of P channel MOSFETs including a constant-current-source transistor M11 connected at its source electrode to the power supply VDD via the power terminal PT, for generating constant current on receipt of a bias signal BS1 from the bias circuit (not shown), a constant-current-source transistor M2 connected at its source electrode to the drain electrode of the transistor M11, for generating constant current on receipt of a bias signal BS2 from the bias circuit (not shown), and transistors M21 and M31 each connected at its source electrode to the drain electrode of the transistor M2. On receipt of control signals VG21 and VG31 from the driver circuit (not shown) respectively, the transistors M21 and M31 operate complementarily to function as current switches (first and second switches).

Further, damping resistance R31 and R41 are provided between the drain electrode of the transistor M31 and the output terminal $\overline{IT}$ and between the drain electrode of the transistor M21 and the output terminal IT, respectively. The output terminal $\overline{IT}$ is directly grounded, while the output terminal IT is grounded via an external resistance R21.

The D/A converter 200 B with such a structure can prevent the output ringing as well.

In the structures described in the first and second preferred embodiments, the damping resistance is provided to reduce the ringing due to the parasitic inductance and the parasitic resistance that are parasitic on the path from the power supply to the ground. The existence of the damping resistance, however, may cause imperfections in operation of the transistors functioning as the current switches. The following third to seventh preferred embodiments provides structures to prevent such imperfections.

3. Third Preferred Embodiment 3-1. Device Structure

Figure 5:
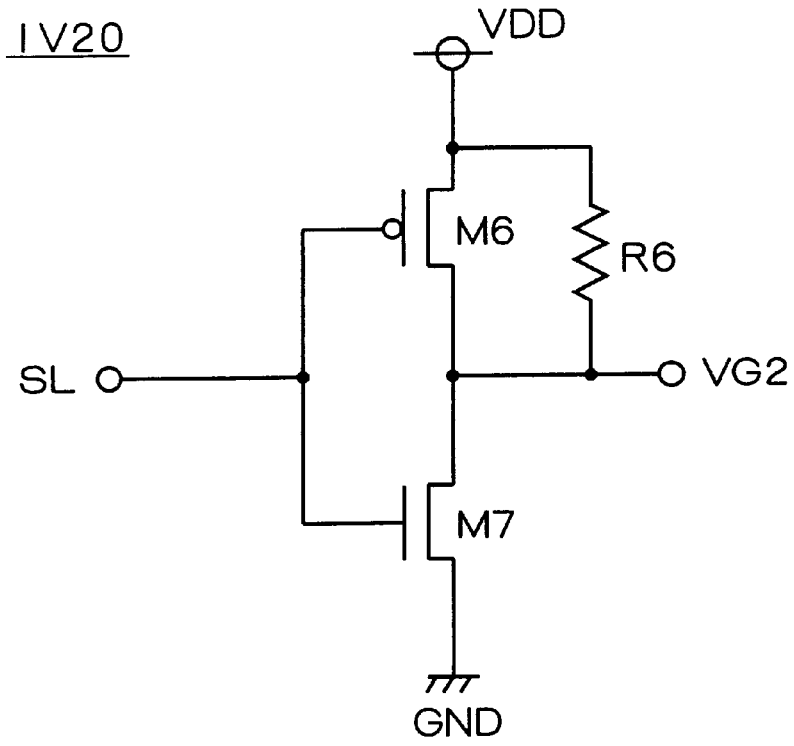
FIG. 5 shows a partial structure of a D/A converter according to a third preferred embodiment of the present invention.

FIG. 5 shows an inverter circuit IV20 for outputting the control signal VG2, among the driver circuits that supply the control signals VG2 and VG3 to the transistors M2 and M3, respectively, in the D/A converter of the second preferred embodiment.

The inverter circuit IV20 comprises a P-channel transistor M6 and an N-channel transistor M7, connected in series between the power supply VDD and the ground and each receiving a selection signal SL at its gate electrode. Further, resistance R6 is provided between the drain and the source of the transistor M6. The control signal VG2 is outputted from a connection node between the drain electrodes of the transistors M6 and M7.

3-2. Characteristic Function and Effect

In the D/A converter 200 of the second preferred embodiment, since the output current of the constant-current-source transistor M1 flows to the damping resistance R4, the drain potential of the transistor M2 becomes larger than the potential of the output terminal IT. Thus, when a large voltage output is taken out at the output terminal IT, the transistor M2 will operate in the non-saturation region since the condition $V_{DS}>V_{GS}-V_{th}$ on which the transistor M2 operates in the saturation region is unsatisfied due to a decrease in a drain-source voltage VDS of the transistor M2 as well as an increase in the drain potential of the transistor M2.

However, through the adoption of the structure shown in FIG. 5, the output of the inverter circuit IV20 to turn on the transistor M2, namely the control signal VG2, is allowed to have a reference potential higher than 0V.

More specifically, when the selection signal SL applied to the inverter circuit IV20 is high and the transistor M7 is turned on, current flows from the power supply VDD through the resistance R6 and the transistor M7 to the ground GND. This makes the reference potential of the control signal VG2 higher than 0V.

Figure 6:
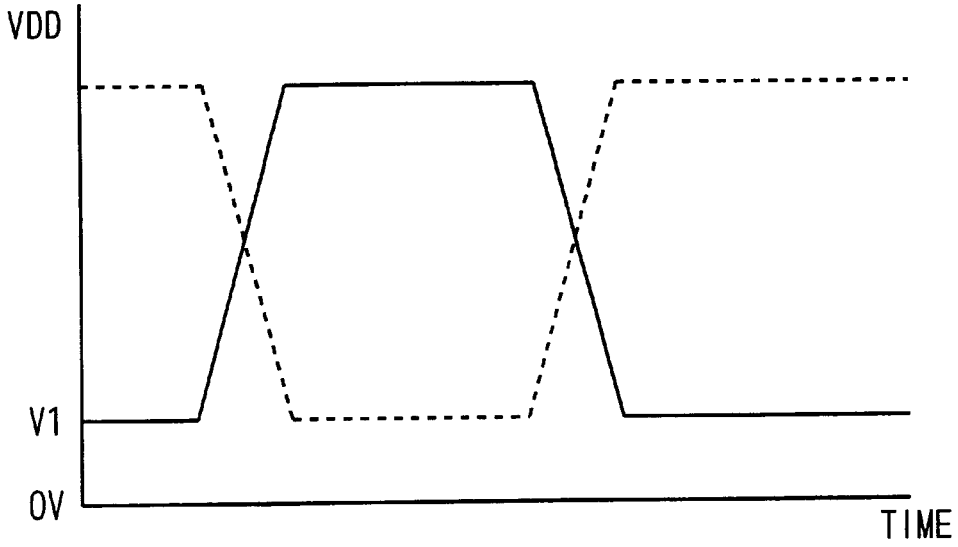
FIG. 6 shows output waveforms of a driver circuit in the D/A converter of the third preferred embodiment.

The waveform of this control signal VG2 is shown by the solid line in FIG. 6. The dotted line in FIG. 6 shows the waveform of the control signal VG3 that is complementary to the control signal VG2 and is supplied from a circuit equivalent to the inverter circuit IV2.

As shown in FIG. 6, the waveform of the control signal VG2 varies between a potential V1 that is higher than 0V and the power potential VDD. This increase the gate potential of the transistor M2, thereby ensuring the operation of the transistor M2 in the saturation region even with small drain-source voltage VDS.

So far described has been the inverter circuit IV20 for outputting the control signal VG2 to the transistor M2 in the D/A converter 200 of the second preferred embodiment. The same structure is applied to the inverter circuit for outputting the control signal VG3 to the transistor M3 in the D/A converter 200.

Further, to improve the symmetry of the operations of the transistors M2 and M3, the damping resistance R3 is set to be equal to the total value of the resistance R2 and the damping resistance R4 in the D/A converter 200. For this reason, the inverter circuit for outputting the control signal VG3 to the transistor M3 needs to have the same structure as the inverter circuit IV20.

Moreover, if there is no damping resistance R3, the inverter circuit for outputting the control signal VG3 to the transistor M3 may have the same structure as the inverter circuit IV20. Alternatively, the circuit may have a general inverter structure, although the operating symmetry of the transistors M2 and M3 is destroyed, to reduce the voltage at the intersection of the control signals VG2 and VG3, i.e., the voltage at which the transistors M2 and M3 are turned on at the same time.

4. Fourth Preferred Embodiment 4-1. Device Structure

Figure 7:
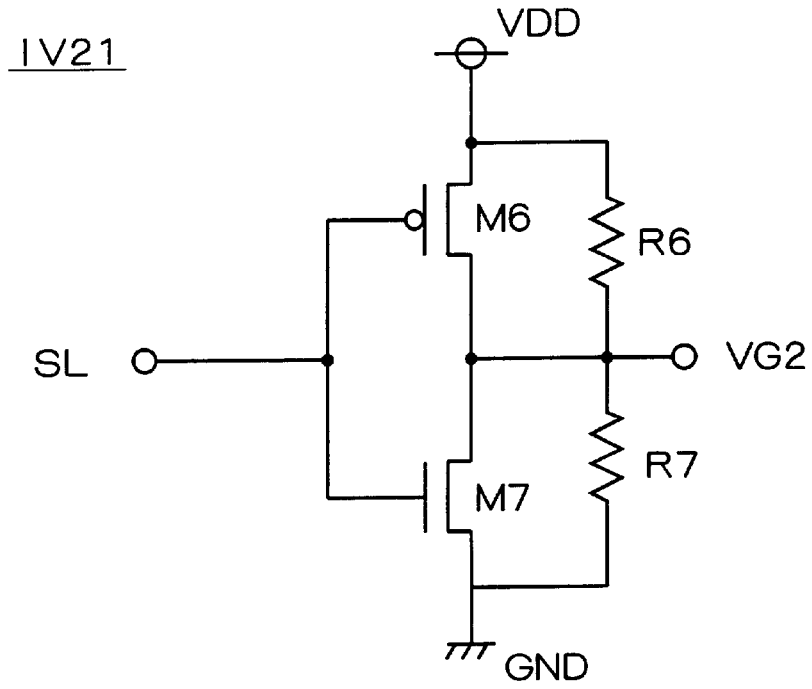
FIG. 7 shows a partial structure of a D/A converter according to a fourth preferred embodiment of the present invention.

FIG. 7 shows an inverter circuit IV21 for outputting the control signal VG2, among the driver circuits for outputting the control signals VG2 and VG3 to the transistors M2 and M3, respectively, in the D/A converter 200 of the second preferred embodiment.

The inverter circuit IV21 comprises a P-channel transistor M6 and an N-channel transistor M7, connected in series between the power supply VDD and the ground and each receiving the selection signal SL at its gate electrode. Further, the resistance R6 is provided between the source and the drain of the transistor M6, and the resistance R7 is provided between the source and the drain of the transistor M7. The control signal VG2 is outputted from the connection node between the drain electrodes of the transistors M6 and M7.

4-2. Characteristic Function and Effect

In such a structure, the output of the inverter circuit IV21 to turn on the transistor M2, namely the control signal VG2, is allowed to have a reference potential higher than 0V, while the output thereof to turn off the transistor M2 is allowed to have a reference voltage lower than the power potential VDD.

More specifically, when the selection signal SL applied to the inverter circuit IV21 is high and the transistor M7 is turned on, current flows from the power supply VDD through the resistance R6 and the transistor M7 to the ground GND. This makes the reference potential of the control signal VG2 higher than 0V. On the other hand, when the selection signal is low and the transistor M6 is turned on, the current flows through the resistance R7 to the ground. This prevents the output from increasing to the power potential VDD, thereby making the reference potential of the output lower than the power potential VDD.

Figure 8:
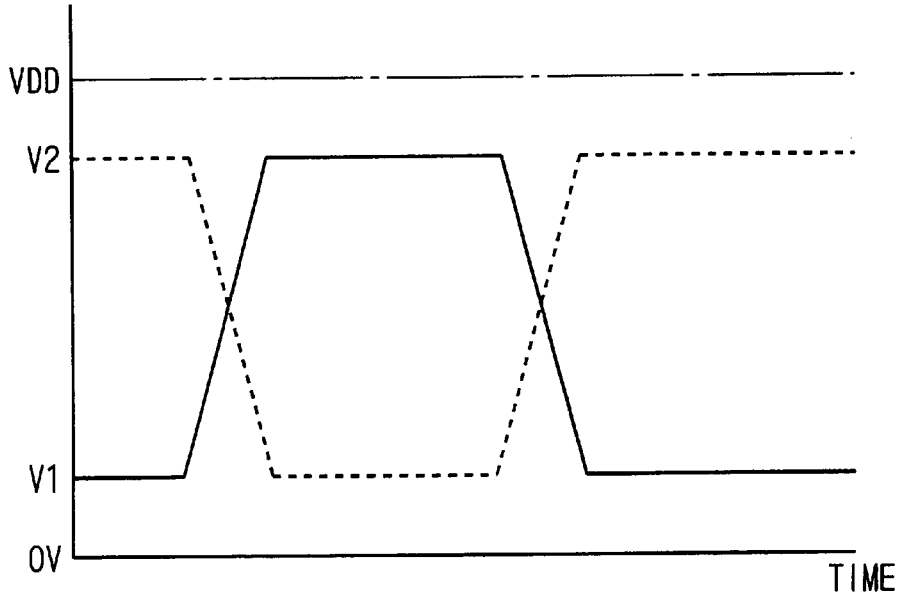
FIG. 8 shows output waveforms of the driver circuit in the D/A converter of the fourth preferred embodiment.

The waveform of this control signal VG2 is shown by the solid line in FIG. 8. The dotted line in FIG. 8 shows the waveform of the control signal VG3 that is complementary to the control signals VG2 and is supplied from a circuit equivalent to the inverter circuit IV21.

As shown in FIG. 8, the waveforms of the control signals VG2 and VG3 vary between the potential V1 that is higher than 0V and a potential V2 that is lower then the power potential VDD. This reduces the voltage at the intersection of the control signals VG2 and VG3, i.e., the voltage at which the transistors M2 and M3 are turned on at the same time, thereby increasing the possibility that the transistors M2 and M3 are turned on at the same time rather than the possibility that the transistors M2 and M3 are turned off at the same time. Thus, the possibility of the generation of ringing can be reduced.

When both of the transistors M2 and M3 are in the off state, charge will be stored in the respective source electrodes and the source potentials of those transistors will be increased. The stored charge is to be discharged as current the instant the transistors M2 and M3 are turned on, which is, however, known to become a trigger of the ringing. Thus, that trigger has to be excluded to reduce the ringing. In order not to have the charge stored in the source electrodes of the transistors M2 and M3, either one of the transistors M2 and M3 is desirably always in the on state. Thus, this preferred embodiment is effective in that the possibility that the transistors M2 and M3 are turned on at the same time is increased.

Further, since the control signals VG2 and VG3 are based on the potential V1 higher than 0V, the gate potentials of the transistors M2 and M3 are increased. This ensures the operations of the transistors in the saturation region, even with small drain-source voltage $V_{DS}$.

So far described has been the inverter circuit IV21 for outputting the control signal VG2 to the transistor M2 in the D/A converter 200 of the second preferred embodiment. The same structure is also applicable to the inverter circuit for outputting the control signal VG3 to the transistor M3 in the D/A converter 200.

5. Fifth Preferred Embodiment 5-1. Device Structure

Figure 9:
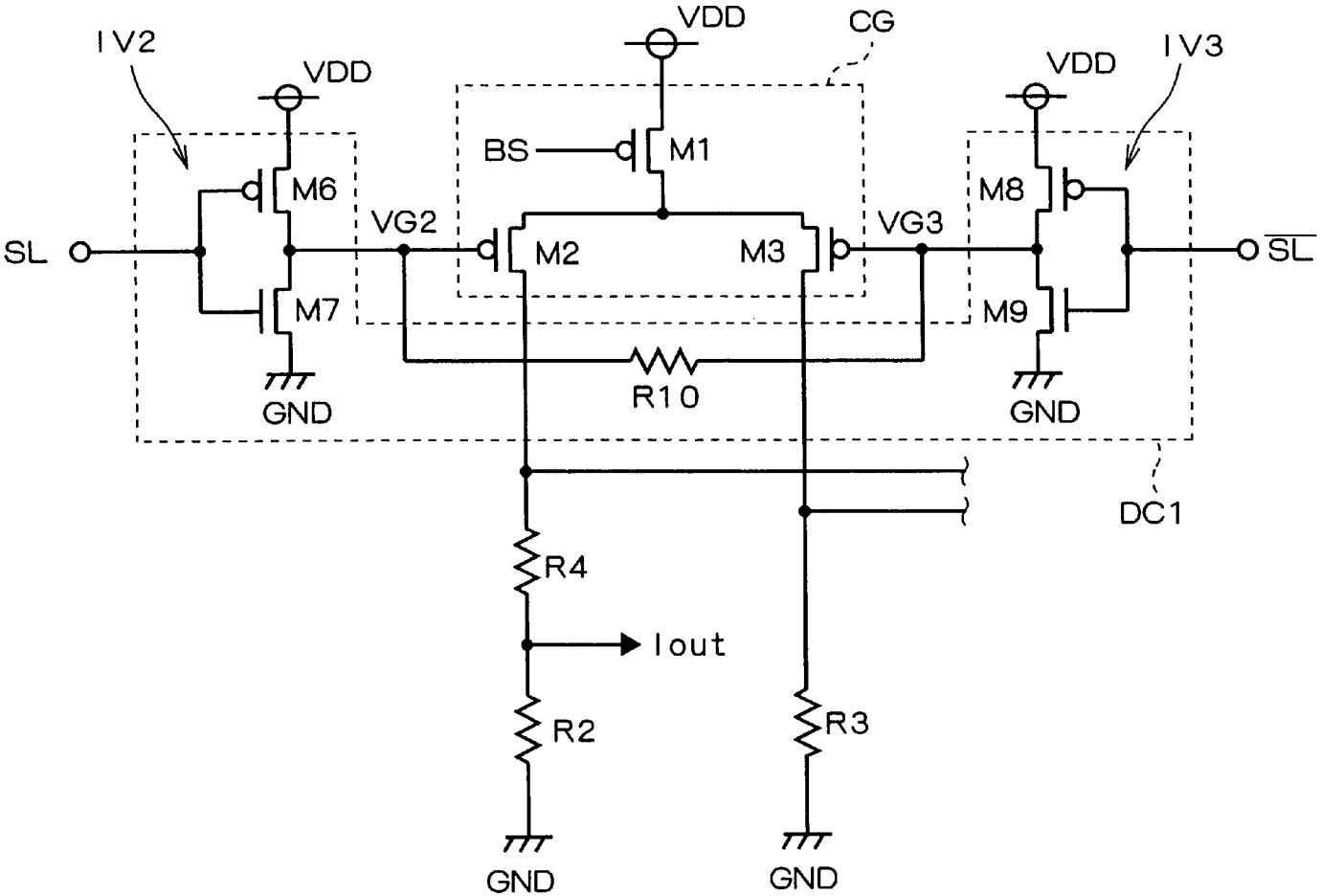
FIG. 9 shows a partial structure of a D/A converter according to a fifth preferred embodiment of the present invention.

FIG. 9 shows a partial structure of a D/A converter 300 in the semiconductor integrated circuit device according to a fifth preferred embodiment of the present invention. In FIG. 9, similar components to those in the D/A converter 200 of the second preferred embodiment are denoted by the same reference numerals and characters to simplify the description.

FIG. 9 shows together a driver circuit DC1 for outputting the control signals VG2 and VG3 to the transistors M2 and M3 respectively, and the current generator CG.

The driver circuit DC1 is composed of the inverter circuits IV2 and IV3 connected at their outputs to the gate electrodes of the transistors M2 and M3 respectively, and resistance R10 connected between the outputs of the inverter circuits IV2 and IV3. The inverter circuit IV2 comprises the P-channel transistor M6 and the N-channel transistor M7, connected in series between the power supply VDD and the ground and each receiving the selection signal SL at its gate electrode. The inverter circuit IV3 comprises a P-channel transistor M8 and an N-channel transistor M9, connected in series between the power supply VDD and the ground and each receiving a selection signal $\overline{SL}$ at its gate electrode. In the drawing, the output of the D/A converter 300 is denoted by lout.

5-2. Characteristic Function and Effect

The inverter circuits IV2 and IV3 are complementary to each other in operation. That is, when the output of the inverter circuit IV2 is high, the output of the inverter circuit IV3 is low. However, since the outputs of the inverters IV2 and IV3 are connected by the resistance R10, current flows from the power supply VDD through the transistor M6, the resistance R10, and the transistor M9 to the ground GND. As a result, the transistor M3 receives at its gate electrode the control signal VG3 whose reference potential is higher than 0V. This increases the gate potential of the transistor M3, by which the transistor M3 can surely operate in the saturation region even with small drain-source voltage $V_{DS}$.

In this case, the transistor M2 receives at its gate electrode the control signal VG2 whose maximum potential is lower than the power potential VDD. As a result, the waveform of this control signal VG2 becomes as shown in FIG. 8 of the fourth preferred embodiment.

Thus, it becomes possible to obtain the effect of ensuring the operation of the transistors in the saturation region even with small drain-source voltage as well as the effect of increasing the possibility that the transistors M2 and M3 are turned on at the same time.

Since each of circuit the inverter circuits IV20 and IV21 therein has its own resistance, the driver circuit described in the third and the fourth preferred embodiments includes a plurality of resistances. On the other hand, the driver circuit DC1 of this preferred embodiment has only one resistance R10. This reduces an area necessary for the resistance on the substrate, thereby achieving downsizing of the device and reducing power consumption.

6. Sixth Preferred Embodiment 6-1. Device Structure

Figure 10:
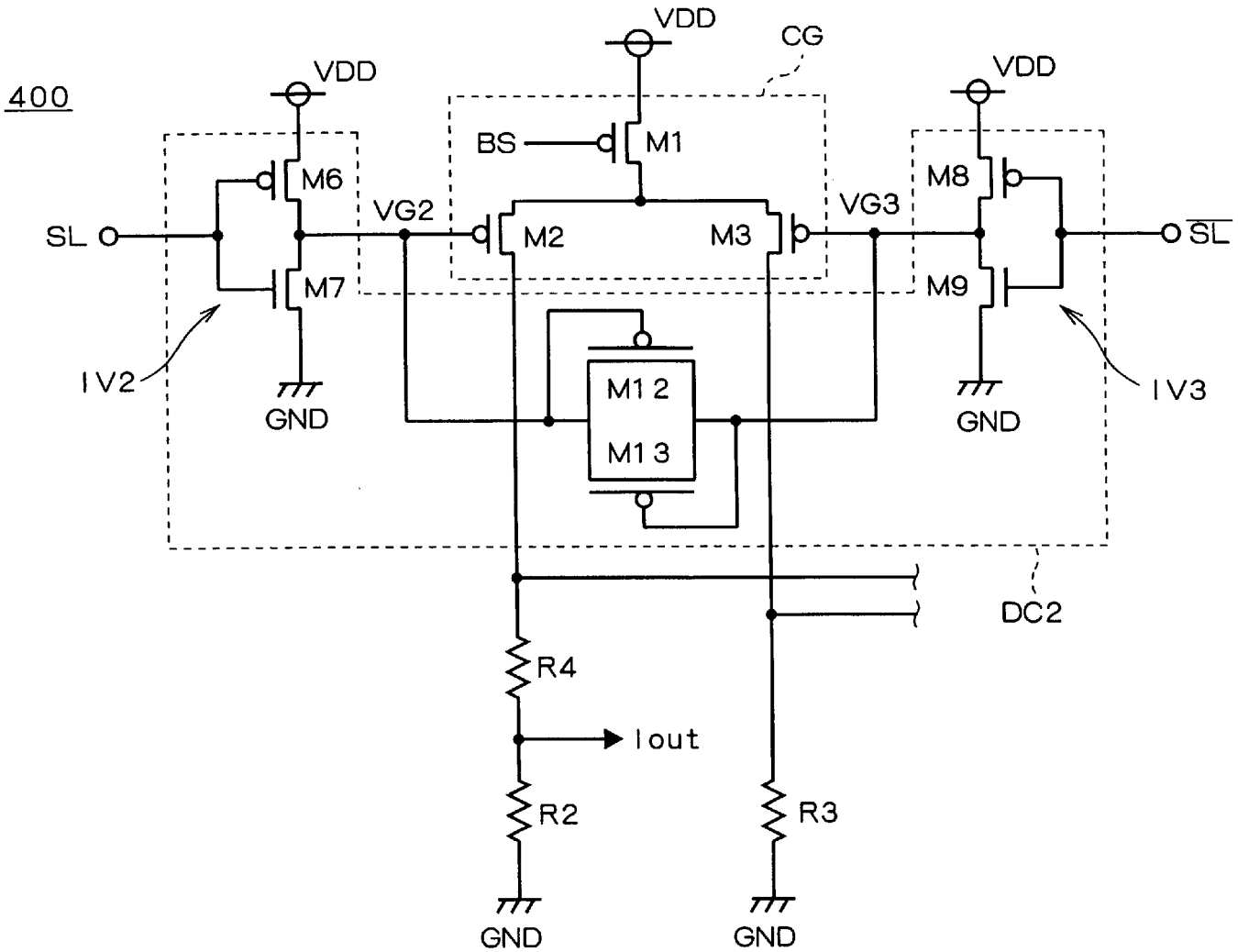
FIG. 10 shows a partial structure of a D/A converter according to a sixth preferred embodiment of the present invention.

FIG. 10 shows a partial structure of a D/A converter 400 in the semiconductor integrated circuit device according to a sixth preferred embodiment of the present invention. In FIG. 10, similar components to those in the D/A converter 300 shown in FIG. 9 are denoted by the same reference numerals and characters to simplify the description.

FIG. 10 shows together a driver circuit DC2 for outputting the control signals VG2 and VG3 to the transistors M2 and M3, respectively, and the current generator CG.

The driver circuit DC2 is composed of the inverter circuits IV2 and IV3 connected at their outputs to the gate electrodes of the transistors M2 and M3 respectively, and two P-channel MOSFETs, namely transistors M12 and M13, having a diode connection and provided between the outputs of the inverter circuits IV2 and IV3.

The transistor M12 is connected at its source electrode to the output of the inverter circuit IV2, at its drain electrode to the output of the inverter circuit IV3 and at its gate electrode to its source electrode. The transistor M13 is connected at its source electrode to the output of the inverter circuit IV3, at its drain electrode to the output of the inverter circuit IV2, and at its gate electrode to its source electrode. In the drawing, the output of the D/A converter 400 is denoted by lout.

6-2. Characteristic Function and Effect

The inverter circuits IV2 and IV3 are complementary to each other in operation. That is, when the output of the inverter circuit IV2 is high, the output of the inverter circuit IV3 is low. At this time, the transistor M12 is in the off state, while the transistor M13 is in the on state. Thus, the transistor M13 operates as a resistive element, and current flows from the power supply VDD through the transistor M6, the transistor M13 (or resistance), and the transistor M9 to the ground GND. Consequently, the transistor M3 receives at its gate electrode the control signal VG3 whose reference potential is higher than 0V, while the transistor M2 receives at its gate electrode the control signal VG2 whose maximum potential is lower than the power supply VDD.

On the other hand, when the output of the inverter circuit IV2 is low, the output of the inverter circuit IV3 is high. At this time, the transistor M12 is in the on state, while the transistor M13 is in the off state. Thus, the transistor M12 operates as the resistive element, thereby bringing about the same effect as described above.

The D/A converter 400 is similar to the D/A converter 300 of the fifth preferred embodiment in that the resistive component is provided between the outputs of the inverter circuits IV2 and IV3. However, because of a large on-state resistance of the MOS transistor, the D/A converter 400 can obtain a large resistance value even with a small transistor and thus needs only a small area in the substrate to obtain the resistance value. This achieves downsizing of the device.

Further, having non-linear current-voltage properties, the transistor having a diode connection can vary the output potential of the D/A converter at lower speed than the resistance. This reduces current variations per unit of time, thereby reducing the ringing. While composed of the P-channel MOSFETs in the drawing, the transistors M12 and M13 may be composed of N-channel MOSFETs.

7. Seventh Preferred Embodiment 7-1. Device Structure

Figure 11:
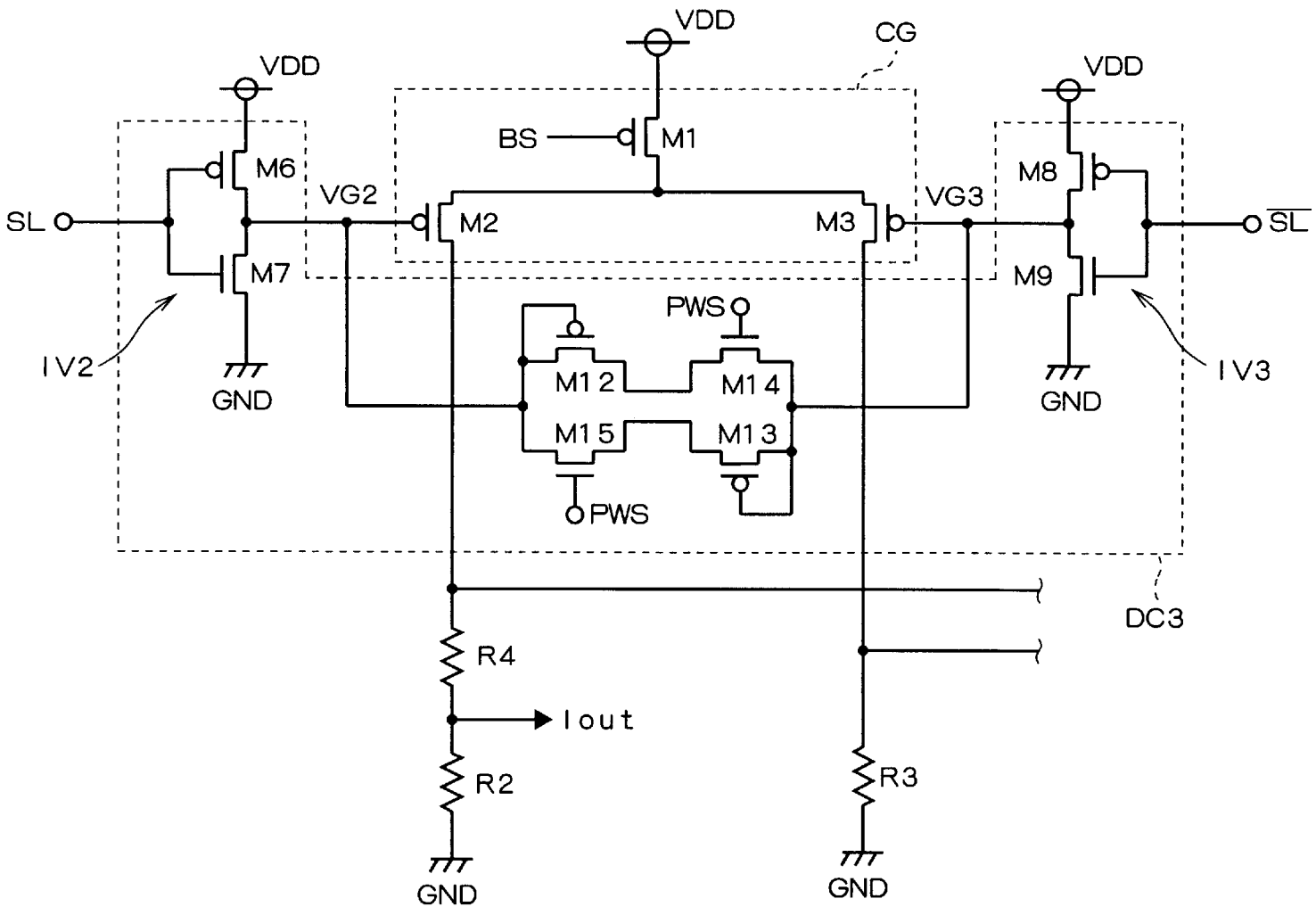
FIG. 11 shows a partial structure of a D/A converter according to a seventh preferred embodiment of the present invention.

FIG. 11 shows a partial structure of a D/A converter 500 in the semiconductor integrated circuit device according to a seventh preferred embodiment of the present invention. In FIG. 11, similar components to those in the D/A converter 300 shown in FIG. 9 are denoted by the same reference numerals and characters to simplify the description.

FIG. 11 shows together a driver circuit DC3 for outputting the control signals VG2 and VG3 to the transistors M2 and M3, respectively, and the current generator CG.

The driver circuit DC3 is composed of the inverter circuits IV2 and IV3 connected at their outputs to the gate electrodes of the transistors M2 and M3, respectively, two P-channel MOSFETs M12 and M13 having a diode connection and provided between the outputs of the inverter circuits IV2 and IV3, and N-channel MOSFETs M14 (first cutoff means) and M15 (second cutoff means) connected in series with the transistors M12 and M13, respectively.

The transistor M12 is connected at its source electrode to the output of the inverter circuit IV2, at its drain electrode to the source electrode of the transistor M14, and at its gate electrode to its source electrode. The transistor M13 is connected at its source electrode to the output of the inverter circuit IV3, at its drain electrode to the source electrode of the transistor M15, and at its gate electrode to its source electrode.

The transistors M14 and M15 are connected at their drain electrodes to the outputs of the inverter circuits IV3 and IV2, respectively, each receiving at its gate electrode a control signal PWS (cutoff signal) that becomes inactive in a power saving (lower power consumption) mode. The control signal PWS is supplied from the outside of the D/A converter 500. In the drawing, the output of the D/A converter is denoted by lout.

7-2. Characteristic Function and Effect

In the D/A converter 500 under normal operating conditions, the control signal PWS is active so that the transistors M14 and M15 are turned on. In that case, the transistors M12 and M13 are turned on or off depending on the outputs of the inverter circuits IV2 and IV3, which brings about the same effect as obtained in the driver circuit DC2 of the sixth preferred embodiment. On the other hand, in the power saving mode, the transistors M14 and M15 are turned off so that the current flowing to the inverter circuits IV2 and IV3 is cut off.

Thus, in the power saving mode, or when the D/A converter is not in use, current does not flow to the transistors M12 and M13. This reduces current consumption. On the other hand, in the normal operating mode, the transistors M14 and M15 are in the on state and thus function as the on-state resistances. While being the P-channel MOSFETs in the drawing, the transistors M12 to M15 may be N-channel MOSFETs.

Next, described in the following eighth and ninth preferred embodiments are structures to reduce the ringing due to the parasitic inductance and the parasitic capacitance when there exists a loop circuit composed only of the parasitic inductance and the parasitic capacitance.

8. Eighth Preferred Embodiment 8-1. Device Structure

Figure 12:
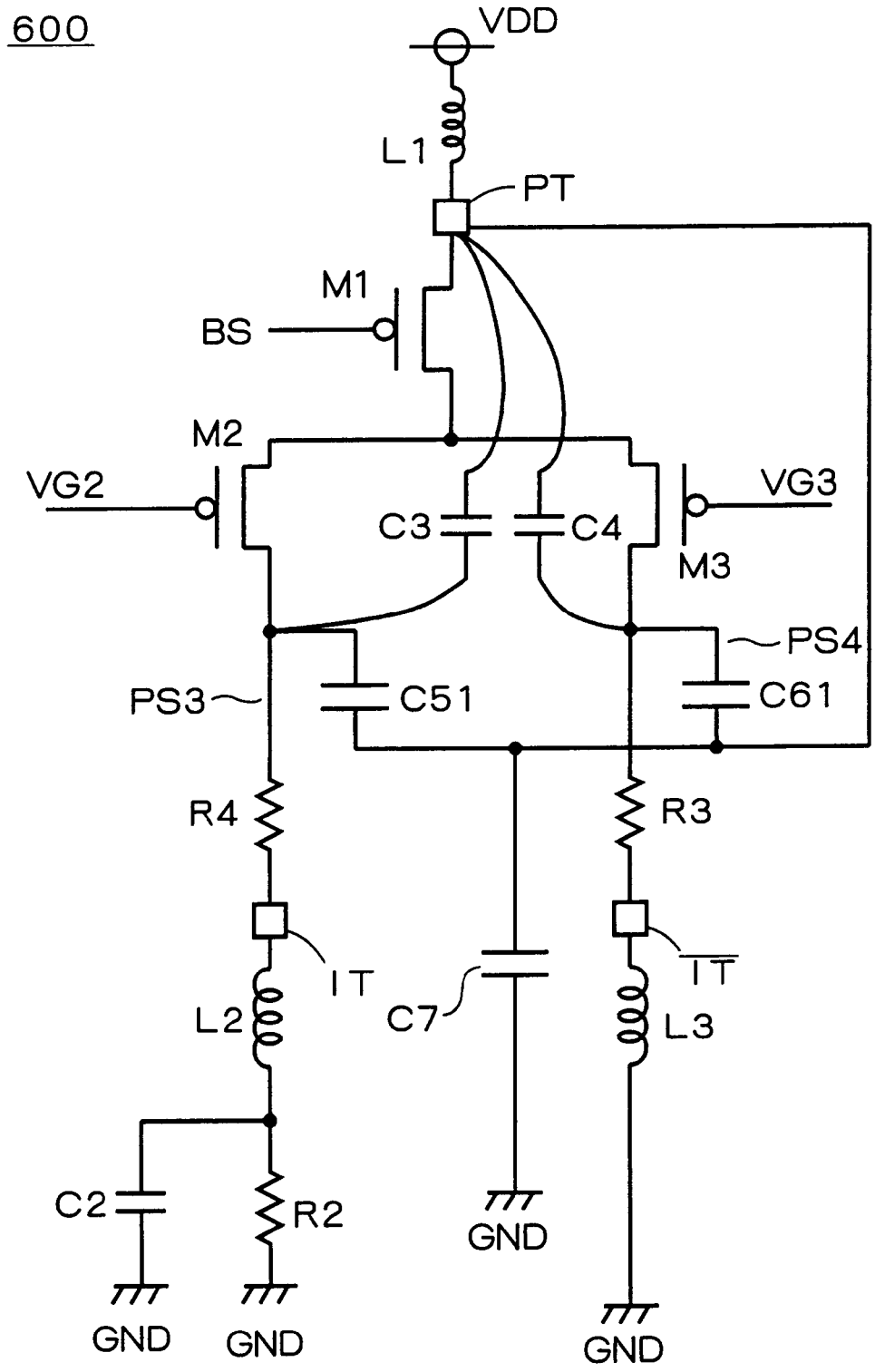
FIG. 12 shows a partial structure of a D/A converter according to an eighth preferred embodiment of the present invention.

FIG. 12 shows a partial structure of a D/A converter 600 in the semiconductor integrated circuit device according to the eighth preferred embodiment of the present invention. In FIG. 12, similar components to those in the D/A converter 200 in FIG. 2 are denoted by the same reference numerals and characters to simplify the description. Further, the inductance components and the capacitance components that are parasitic on the D/A converter 600 are shown as inductance and capacitance, respectively, in the drawing.

In FIG. 12, there exist parasitic capacitance C51 between the drain electrode of the transistor M2 and the power terminal PT connected to the power supply VDD, and parasitic capacitance C61 between the drain electrode of the transistor M3 and the power terminal PT. Further, there exists parasitic capacitance C7 connected in series with both the parasitic capacitance C51 and C61.

Figure 32:
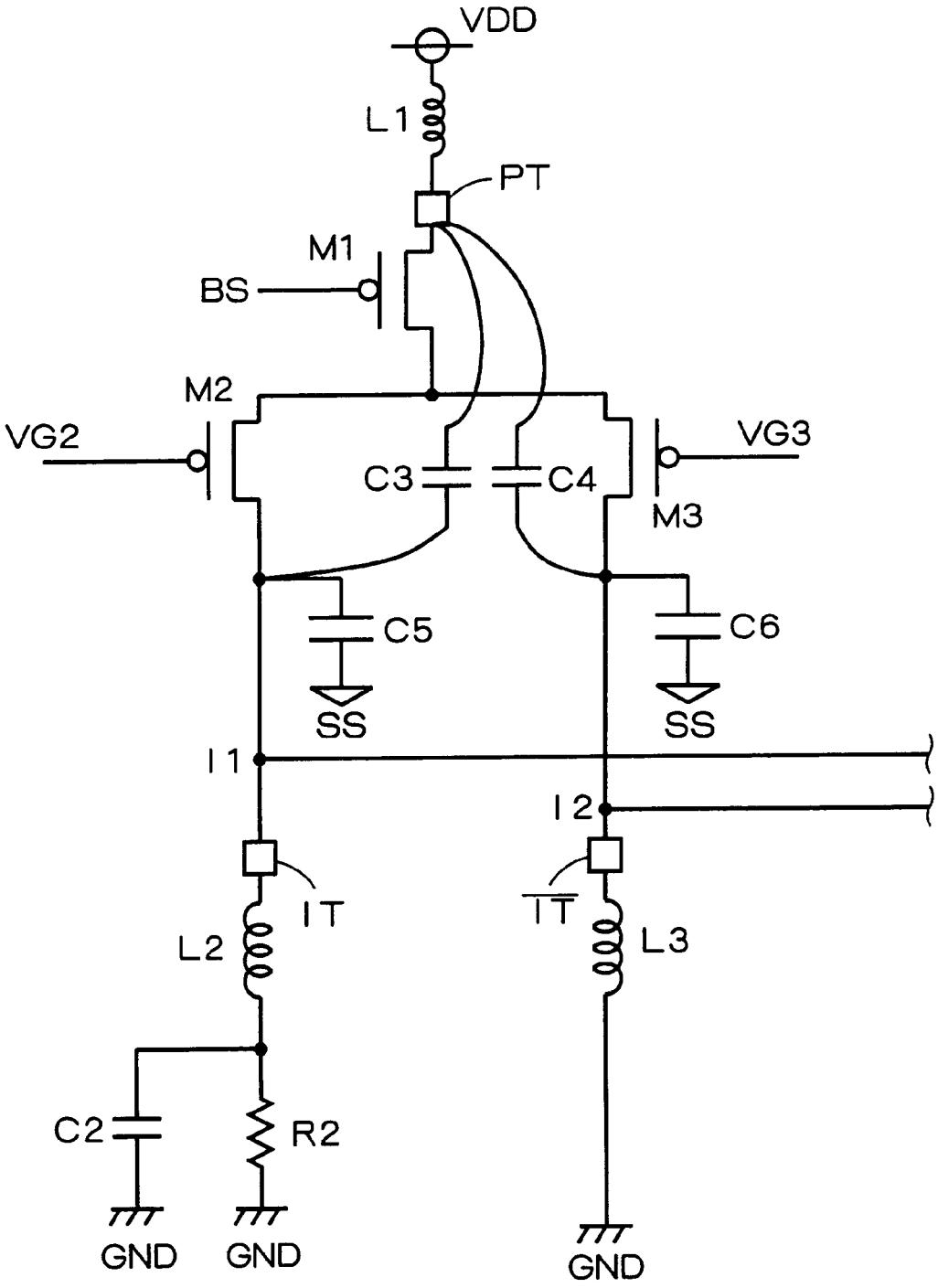
FIG. 32 (BACKGROUND ART)
FIGS. 32 to 35 show partial structures of the conventional D/A converter.

Because of the parasitic capacitance C7 connected in series with the parasitic capacitance C51 and C61, their combined capacitance becomes smaller than that of the parasitic capacitance C5 and C6 shown in FIG. 32. This reduces the ringing due to the third circuit PS3 composed of the substrate SS, the parasitic capacitance C5, the parasitic inductance L2, the parasitic capacitance C2, and the ground GND, and due to the fourth circuit PS4 composed of the substrate SS, the parasitic capacitance C6, the parasitic inductance L3, and the ground GND.

8-2. D/A Converter Layout

To reduce the ringing by forming the parasitic capacitance C7 as described above, the layout of the circuit pattern needs to be modified.

Figure 13:
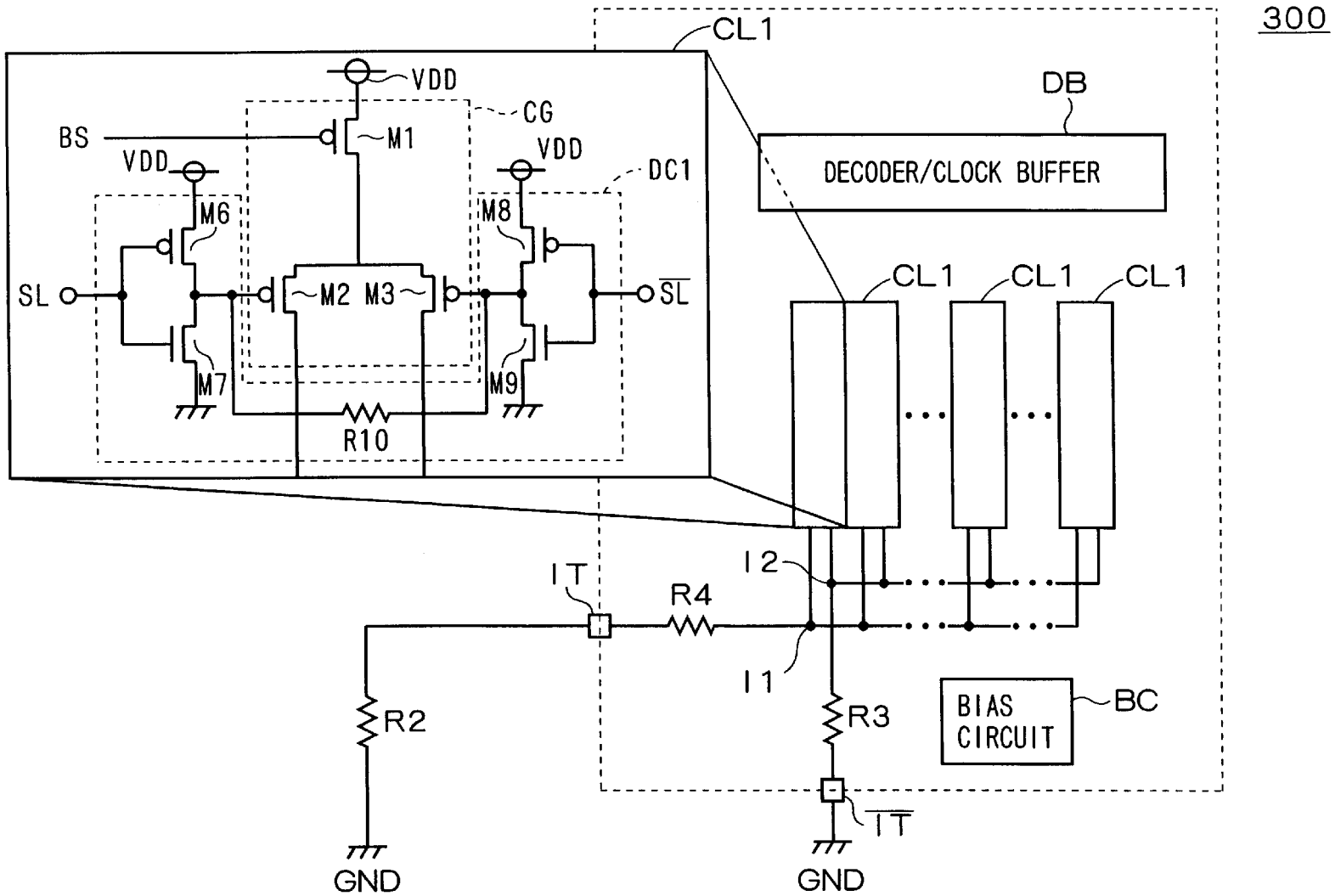
FIG. 13 shows an overall structure of the D/A converter with the application of the present invention.

We will described the overall structure of the D/A converter, referring to FIG. 13. FIG. 13 is a general view of the D/A converter 300 shown in FIG. 9. The D/A converter 300 is mainly composed of a plurality of current source cells CL1, and moreover includes the decoder/clock buffer portion DB connected to the current source cells CL1, the bias circuit BC, and so on.

Each of the current source cells CL1 has the output node I1 connected to the output terminal IT, and the output node 12 connected to the output terminal $\overline{IT}$. The output terminal IT is grounded via the external resistance R2, while the output terminal $\overline{IT}$ is directly grounded.

The current source cell CL1 is composed of the current generator CG and the driver circuit DC1 shown in FIG. 9. Similar components to those in FIG. 9 are denoted by the same reference numerals and characters to simplify the description. The selection signal SL and a selection signal $\overline{SL}$ that will be described later are supplied from the decoder in the decoder/clock buffer portion DB.

Figure 14:
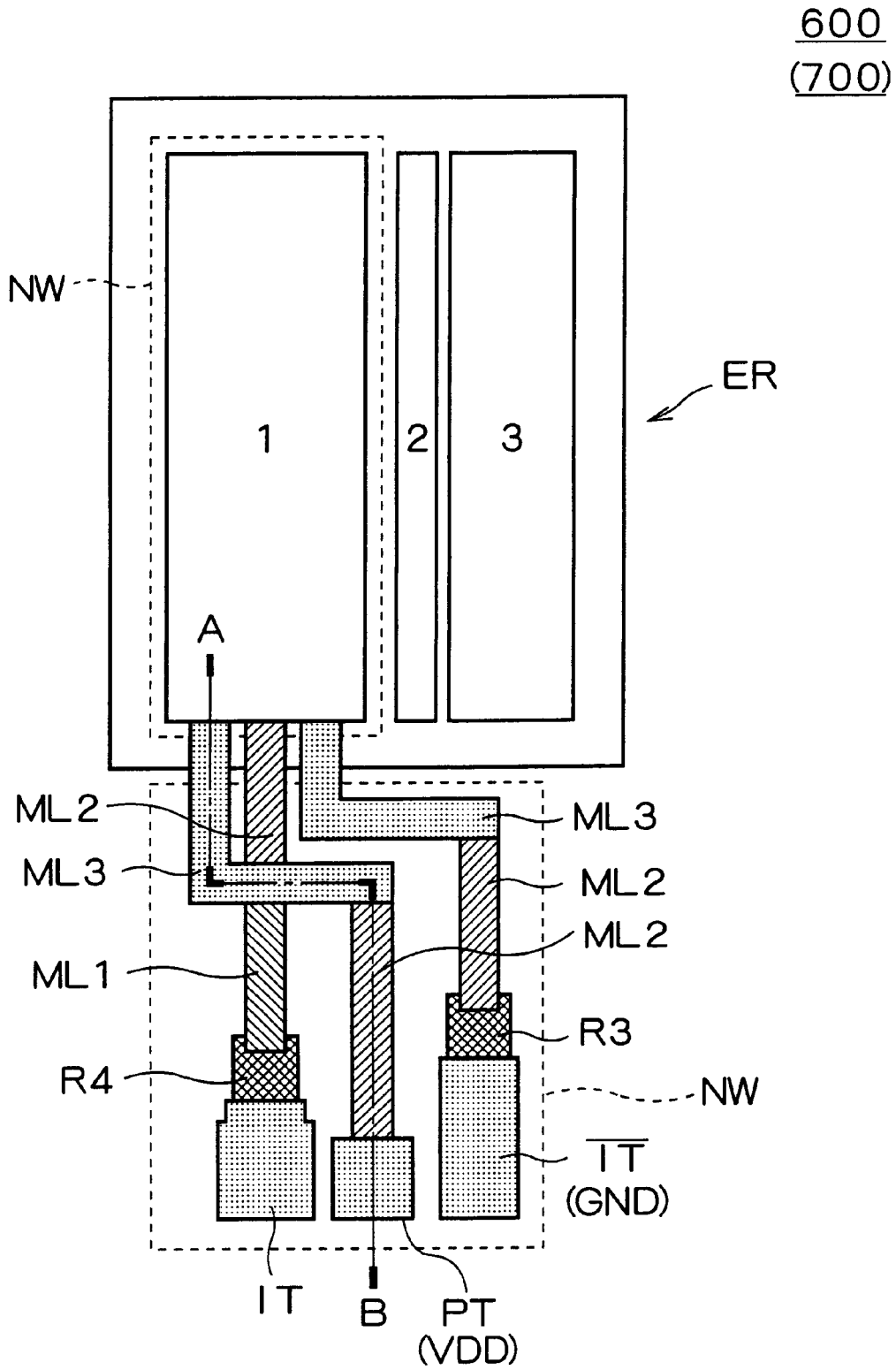
FIG. 14 shows the layout of the D/A converter of the eighth preferred embodiment.

FIG. 14 shows the layout of the D/A converter 600 obtained by applying this preferred embodiment to the D/A converter 300 in FIG. 13. In FIG. 14, formed within the element-forming region ER are a current-source array 1 with the current generators CG in the current-source cells CL1 in FIG. 13 arranged therein, a driver array 2 with the driver circuits DC1 in the current-source cells CL1 arranged therein, and a peripheral circuit portion 3 including the decoder/clock buffer portion DB, the bias circuit BC and so on. Further, the damping resistance R3 and R4, the output terminals IT and $\overline{IT}$, and the power terminal PT are formed above the N-well region NW outside the element-forming region ER.

Such a structure allows the formation of the parasitic capacitance C7 in series with the parasitic capacitance C51 an C61. This mechanism will be described, taking an example, the structure of the output terminal IT.

Figure 15:
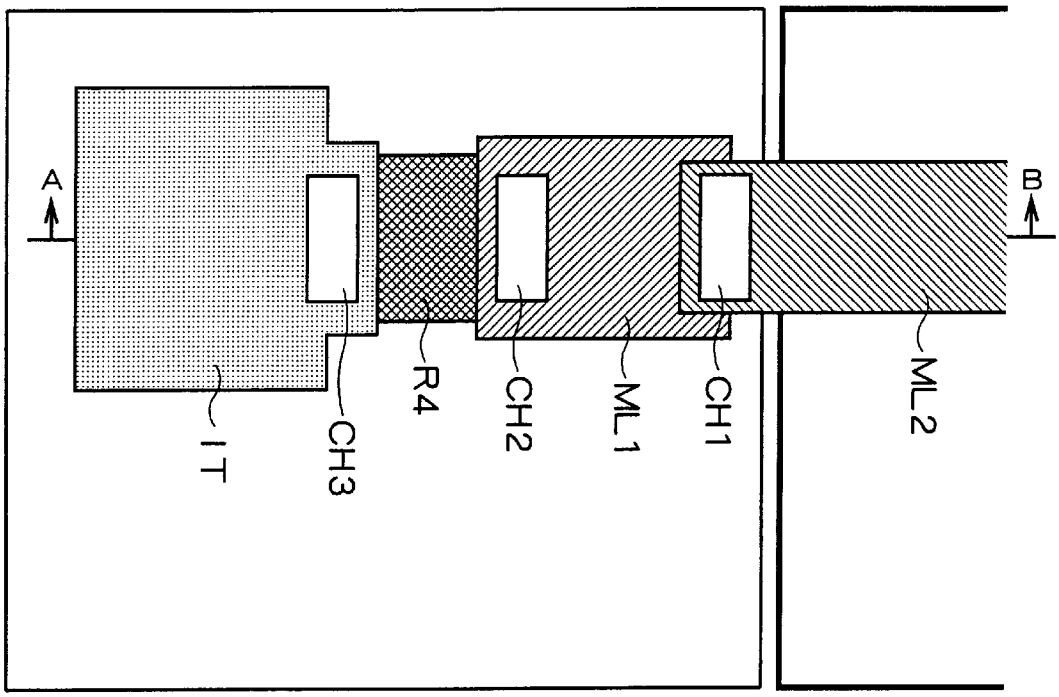
FIG. 15 is a partial view of the layout of the D/A converter of the eighth preferred embodiment.

FIG. 15 shows the layout of the output terminal IT and a portion connected thereto. In FIG. 15, a wiring path is formed from the element-forming region ER through a second wiring layer ML2, a first wiring layer ML1, and the resistance R4 to the output terminal IT. The first and second wiring layers ML1 and ML2 are connected by a contact hole CH1, the first wiring layer ML1 and the resistance R4 by a contact hole CH2, and the resistance R4 and the output terminal IT by a contact hole CH3.

Figure 16:
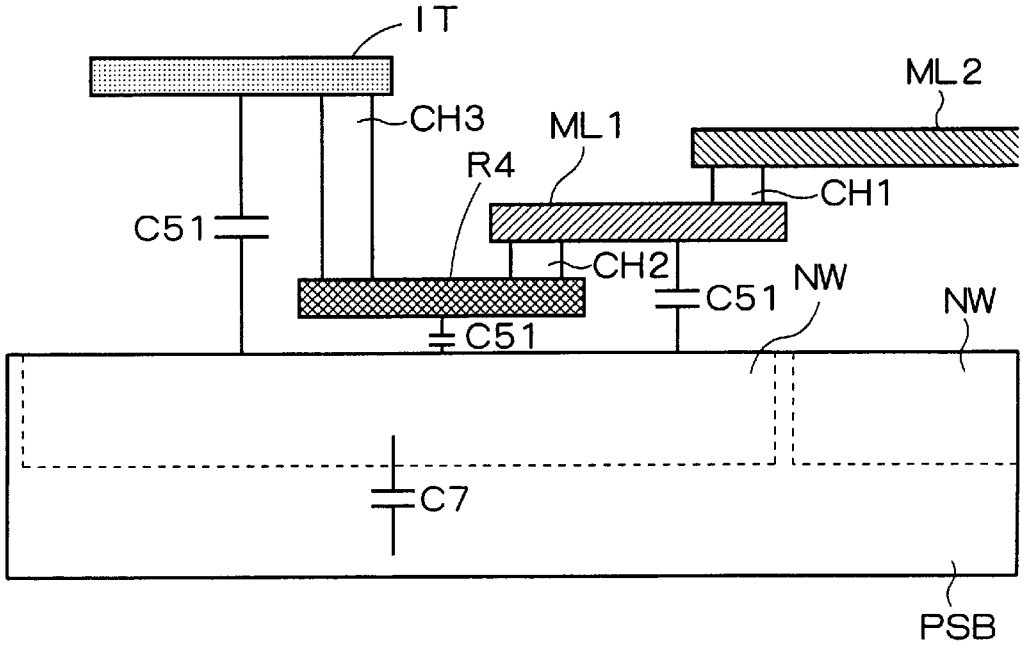
FIG. 16 is a partial sectional view of the layout of the D/A converter of the eighth preferred embodiment.

A section taken along a line A–B in FIG. 15 is shown in FIG. 16. As shown, the second wiring layer ML2 is formed above the first wiring layer ML1, and the output terminal IT is formed above the second wiring layer ML2. These are formed above the N-well region NW formed in the surface of a P-type semiconductor substrate PSB. Thus, the parasitic resistance C7 can be formed between the N-well region NW and the P-type semiconductor substrate PSB, even in the presence of the parasitic capacitance C51 between the N-well region NW, and the first wiring layer ML1, the resistance R4, or the output terminal IT. In this case, the parasitic capacitance C51 and C7 are connected in series with each other, so that their combined capacitance becomes smaller than the parasitic capacitance C5.

The same applies to the output terminal $\overline{IT}$, the resistance R3 connected to the output terminal $\overline{IT}$, the second wiring layer ML2, and a third wiring layer ML3. In that case, the parasitic capacitance C61 is connected in series with the parasitic capacitance C7. Further, the third wiring layer ML3 is formed above the second wiring layer ML2, while the output terminals IT and $\overline{IT}$ and the power terminal PT are formed at the same level as the third wiring layer ML3.

Moreover, in order to fix the potential of the N-well region NW, the power terminal PT needs to be electrically connected to the N-well region NW as shown in FIG. 12. For that reason, a contact hole is provided to connect the power terminal PT and the N-well region NW.

While it is obvious to form the N-well region NW within the element-forming region ER. the technical idea of providing the external connection terminals on the N-well region as well is original to the inventors of the present invention. Further, the P-type semiconductor substrate PSB may be substituted by an N-type semiconductor substrate. In that case, a P-well region with P-type impurities introduced therein is used instead of the N-well region NW.

Although crossing over the wiring path to the output terminal IT in the example of FIG. 14, the wiring path to the power terminal PT may be in parallel with that path.

9. Ninth Preferred Embodiment 9-1. Device Structure

Figure 17:
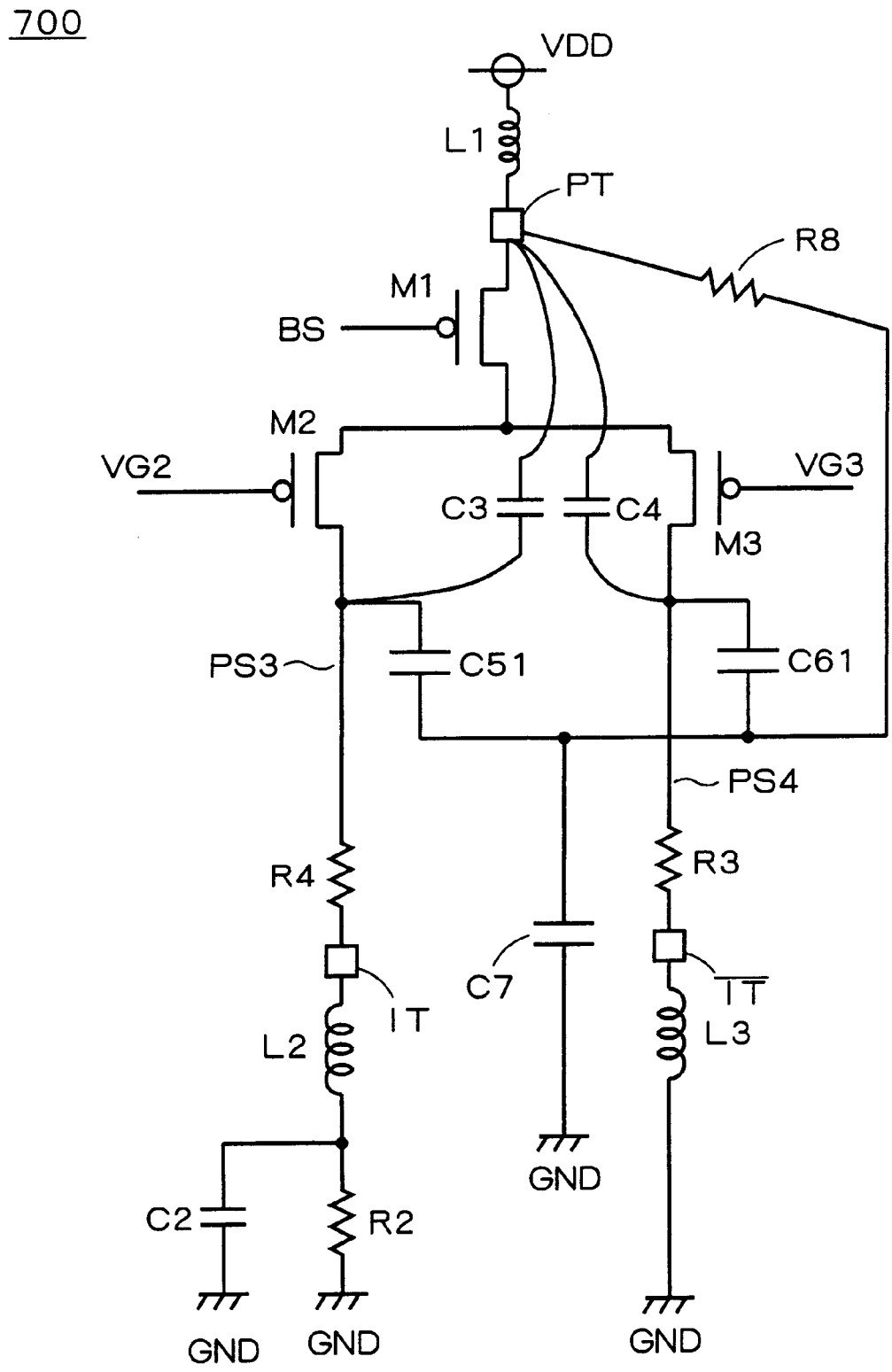
FIG. 17 shows a partial structure of a D/A converter according to a ninth preferred embodiment of the present invention.

FIG. 17 shows a partial structure of a D/A converter 700 in the semiconductor integrated circuit device according to a ninth preferred embodiment of the present invention. In FIG. 17, similar components to those in the D/A converter 200 in FIG. 2 are denoted by the same reference numerals and characters to simplify the description. Further, inductance components and capacitance components that are parasitic on the D/A converter 700 are shown as inductance and capacitance, respectively, in the drawing.

In FIG. 17, the power terminal PT connected to the power supply VDD is connected to damping resistance R8, and there are the parasitic resistances C51 and C61 between one end of the damping resistance R8 and the drain electrodes of the transistors M2 and M3, respectively. Then, the parasitic capacitance C7 is provided in series connection with both the parasitic capacitance C51 and C61.

In the D/A converter 600 shown in FIG. 12, the values of the parasitic capacitance C51 and C61 are reduced by locating the parasitic capacitance C7 in series connection, by which the ringing due to the third and the fourth circuits PS3 and PS4 is reduced. However, even if having smaller values, the parasitic capacitance C51 and C61 still exist and allow the formation of the paths from the power supply VDD through the parasitic inductance L1 to the third and the fourth circuits PS3 and PS4. Thus, further reduction in ringing is impossible in this structure.

On the other hand, the D/A converter 700 has the damping resistance R8 as shown in FIG. 17, which eliminates the circuit consisting only of the parasitic capacitance and the parasitic inductance and thereby reduces the ringing. The mechanism of this reduction in ringing by the damping resistance R8 is the same as described in the first preferred embodiment using the equations (1) to (3).

Figure 18:
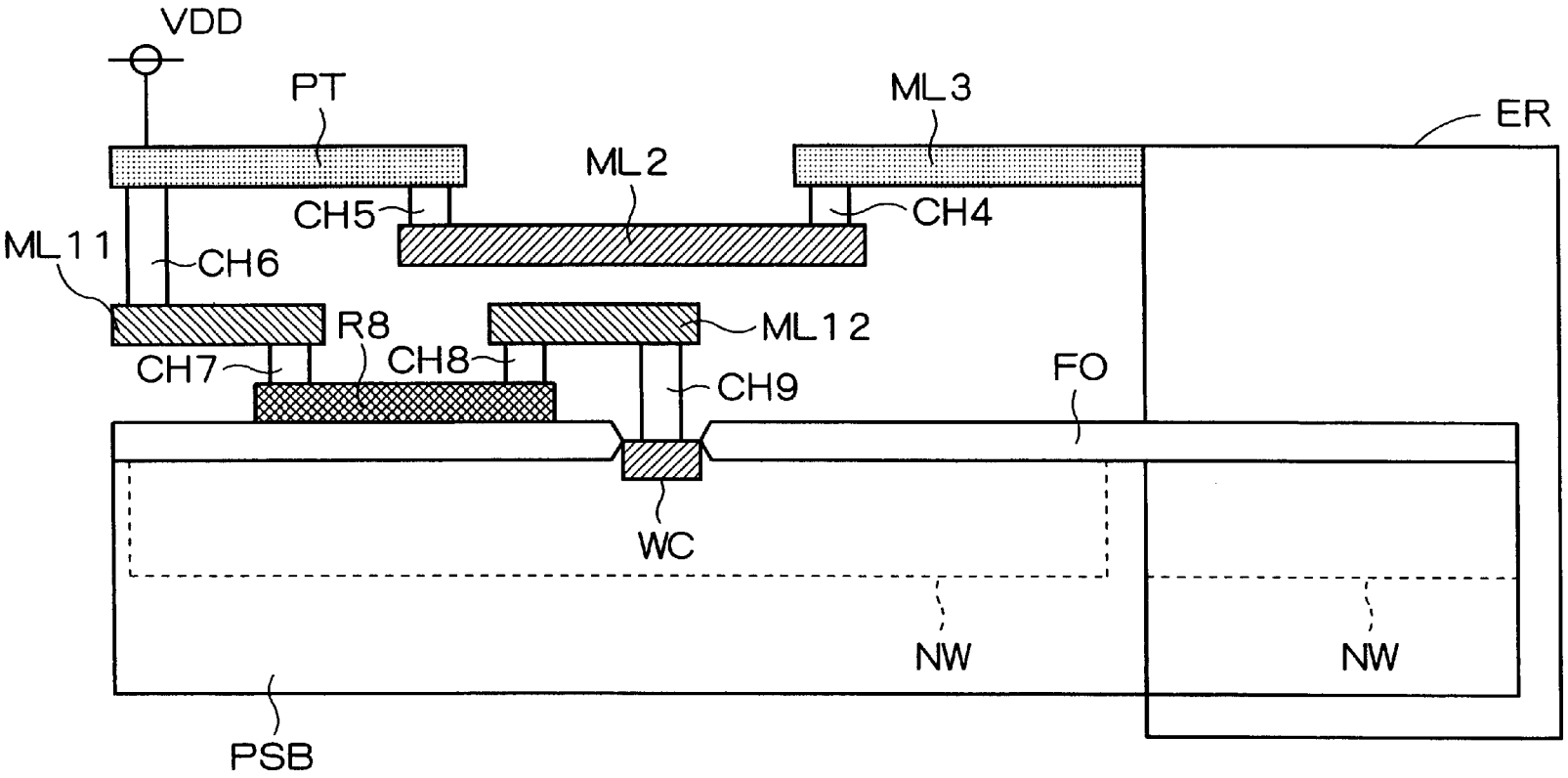
FIGS. 18 and 19 are partial sectional views of the layout of the D/A converter of the ninth preferred embodiment.

The layout of the D/A converter 700 with the damping resistance R8 will be described, referring to FIG. 14 which is used to describe the layout of the D/A converter 600. In FIG. 14, a wiring path is formed from the element-forming region ER through the third wiring layer ML3 and the second wiring layer ML2 to the power terminal PT. Although not in this drawing, the location of the damping resistance R8 is shown in the section taken along a line A–B in FIG. 14. FIG. 18 shows one example of such a section.

As shown in FIG. 18, the third wiring layer ML3 and the second wiring layer ML2 are connected by a contact hole CH4, and the second wiring layer ML2 and the power terminal PT are connected by a contact hole CH5. The damping resistance R8 is provided below the second wiring layer ML2 and the power terminal PT. Formed on a field oxide film FO, the damping resistance R8 is connected at its one end to the wiring layer ML11 by a contact hole CH7 and at its other end to the wiring layer ML12 by a contact hole CH8. The ML11 is electrically connected to the power terminal PT by a contact hole CH6, while the wiring layer ML12 is electrically connected to a well contact WC by a contact hole CH9. The well contact WC, extending through the filed oxide film FO to the N-well region, is formed of an $N^+$ layer having N-type impurity concentration that is set higher than that of the N-well region to reduce contact resistance. Further, the damping resistance R8 is composed of a polysilicon layer and so on.

Figure 19:
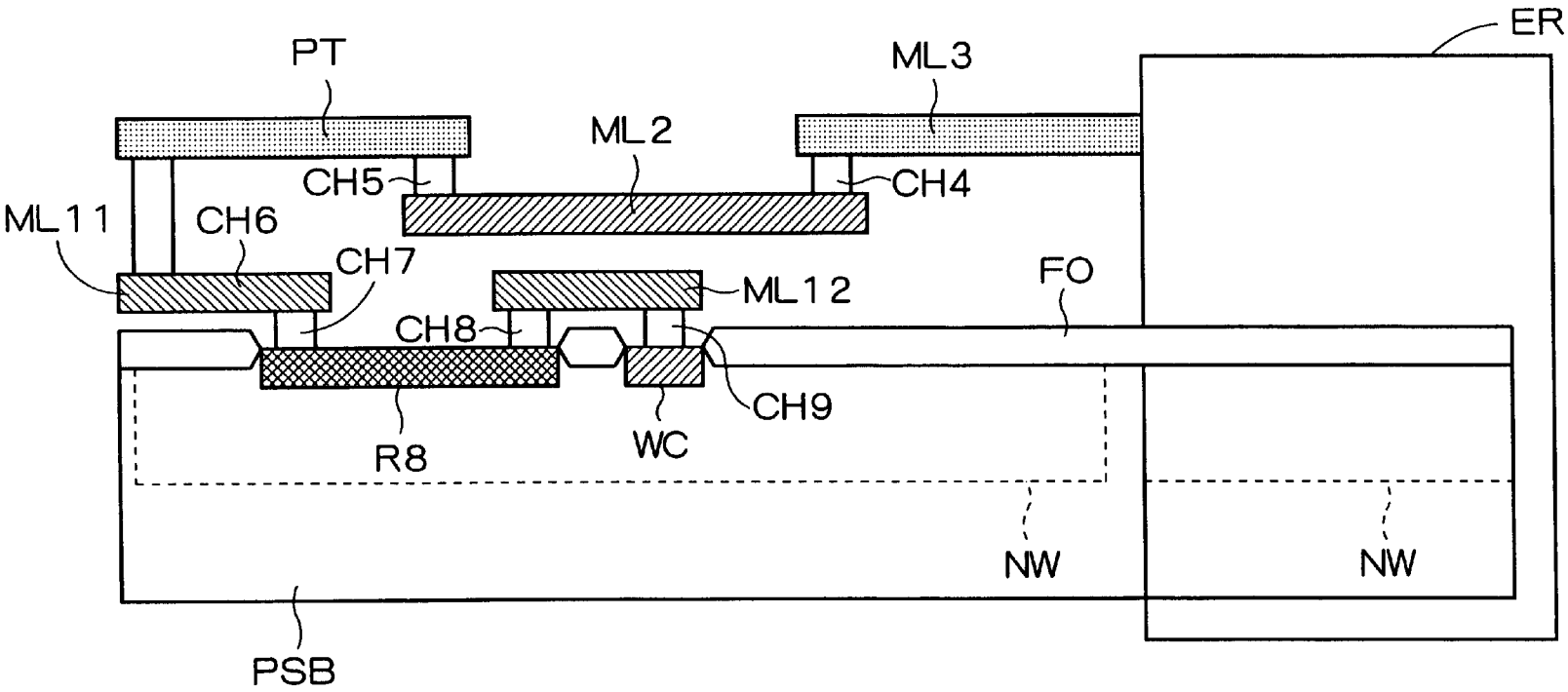

FIG. 19 shows another example of the section taken along the line A–B in FIG. 14. As shown, the third wiring layer ML3 and the second wiring layer ML2 are connected by the contact hole CH4, and the second wiring layer ML2 and the power terminal PT are connected by the contact hole CH5. The damping resistance R8 is provided below the second wiring layer ML2 and the power terminal PT. Here, the damping resistance R8 is formed by diffusing P-type impurities within the surface of the N-well region NW. Further, the damping resistance R8 is connected at its one end to the wiring layer ML11 by the contact hole CH7 and at its other end to the wiring layer ML12 by the contact hole CH8. The wiring layer ML11 is electrically connected to the power terminal PT by the contact hole CH6, while the wiring layer ML12 is electrically connected to the well contact WC by the contact hole CH9.

9-2. Plane Form of Damping Resistance

Although not referred to in the foregoing description, the damping resistance R8 may have a sinusoidal plane form to increase its resistance value.

Figure 20:
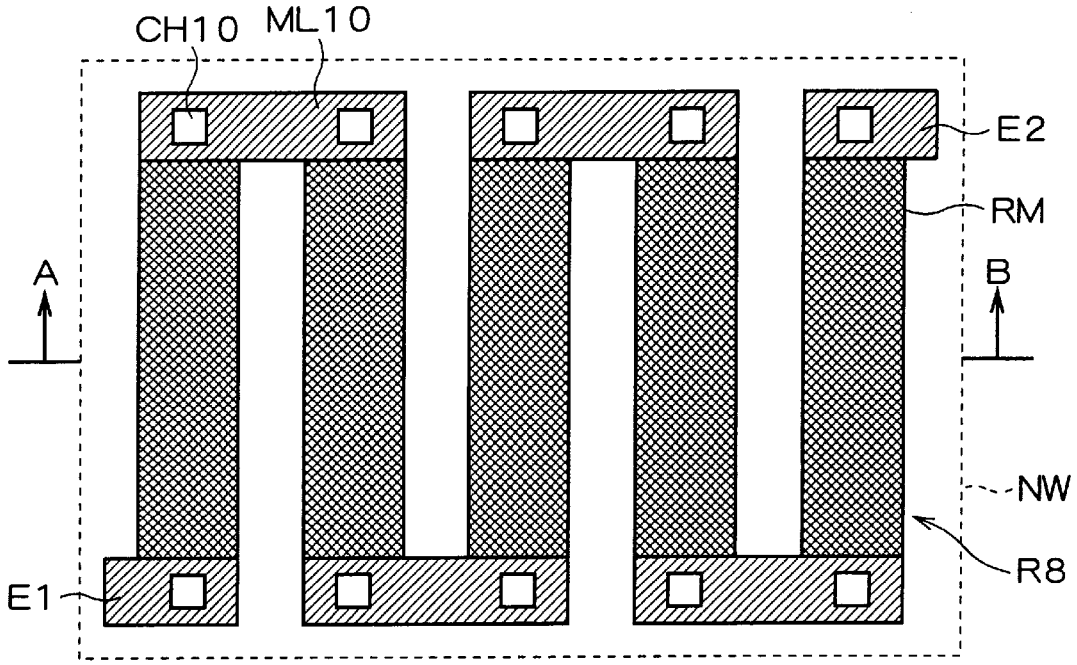
FIG. 20 shows a plane form of a resistance applied to the D/A converter of the ninth preferred embodiment.
Figure 21:
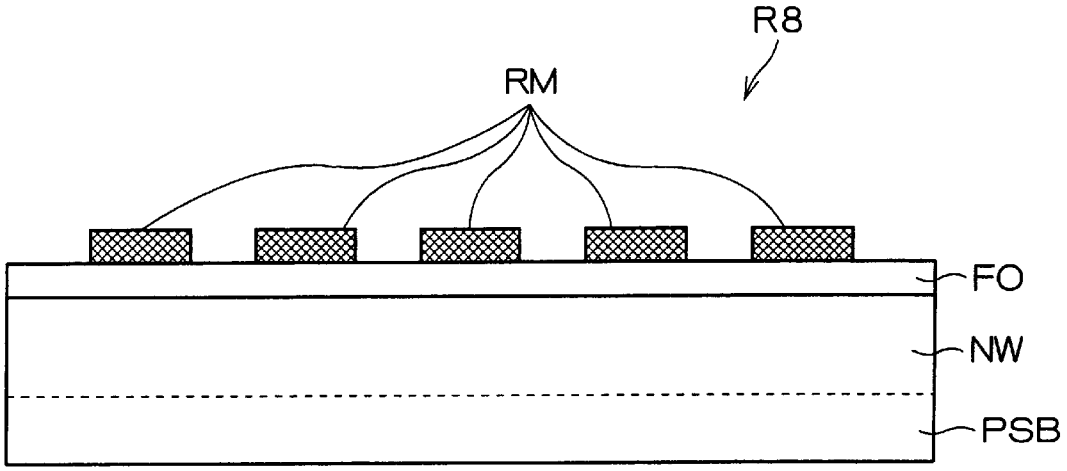
FIG. 21 shows a sectional form of the resistance applied to the D/A converter of the ninth preferred embodiment.

FIG. 20 shows the plane form of the damping resistance R8 when formed of a polysilicon layer, and FIG. 21 shows the sectional structure taken along a line A–B in FIG. 20. As shown in FIGS. 20 and 21, the damping resistance R8 is composed of a plurality of resistors RM arranged in parallel with each other on the field oxide film FO, with a plurality of wiring layers ML10 and contact holes 10 electrically connecting those resistors RM in series. Of the wiring layers ML10, wiring layers E1 and E2 corresponding to the both ends of the damping resistance R8 will be electrically connected to the power terminal PT and the well contact WC, respectively.

Figure 22:
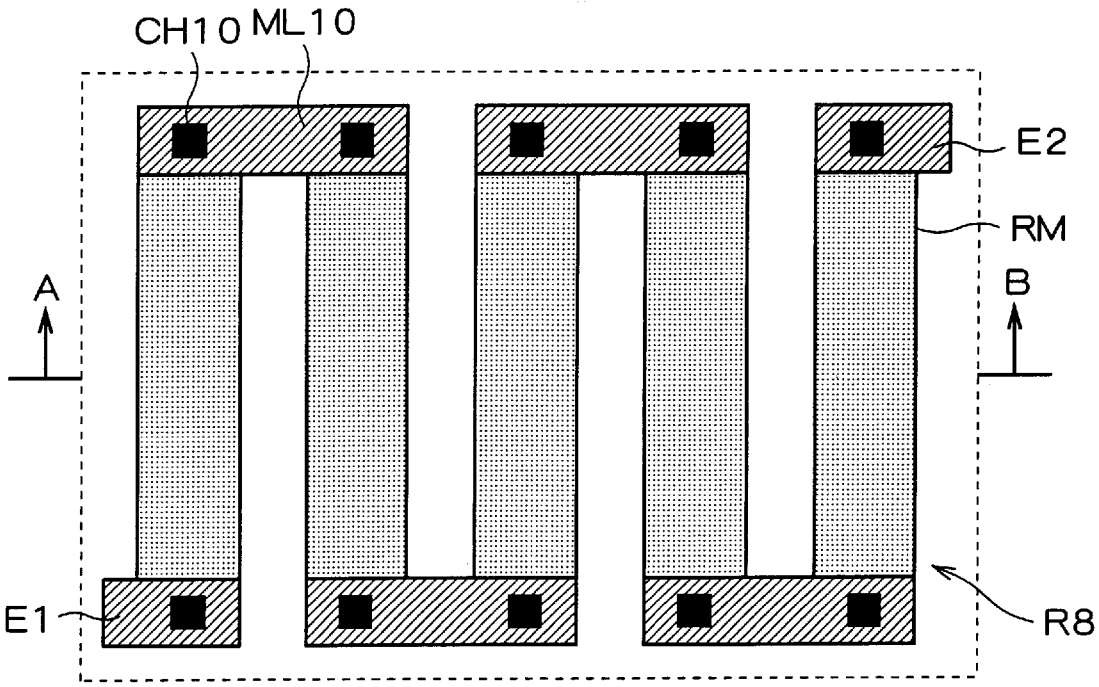
FIG. 22 shows a plane form of the resistance applied to the D/A converter of the ninth preferred embodiment.
Figure 23:
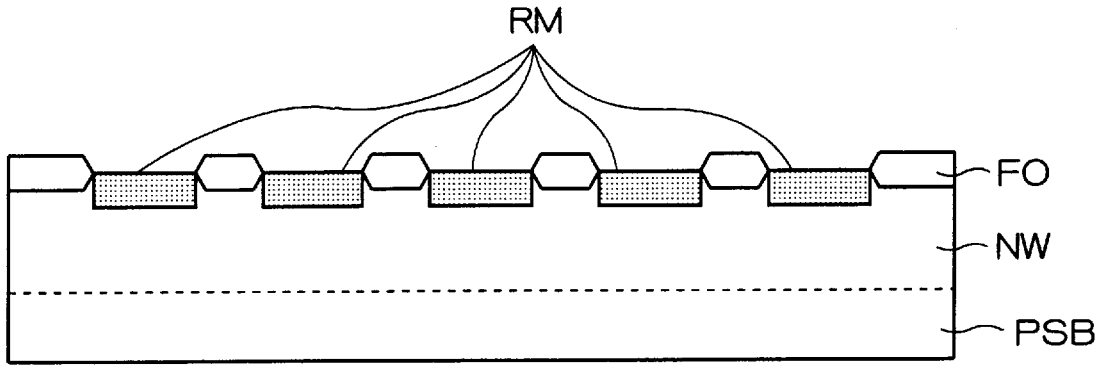
FIG. 23 shows a sectional form of the resistance applied to the D/A converter of the ninth preferred embodiment.

Moreover, FIG. 22 shows the plan form of the damping resistance R8 when formed of an impurity diffusion layer, and FIG. 23 shows the sectional structure taken along a line A–B in FIG. 22. As shown in FIGS. 22 and 23, the damping resistance R8 is composed of a plurality of resistors RM arranged in parallel with each other within the surface of the N well region, with the plurality of wiring layers ML10 and the contact holes CH10 electrically connecting those resistors RM in series. Of the wiring layers ML10, the wiring layer E1 and E2 corresponding to the both ends of the damping resistance R8 will be electrically connected to the power terminal PT and the well contact WC, respectively.

Alternatively, instead of connecting the parallel resistors RM by the wiring layers ML10 and the contact holes CH10 as shown in FIGS. 20 and 22, a sinuous resistor may be used to form the sinuous damping resistance R8.

9-3. Modification

So far described in the ninth preferred embodiment is a single D/A converter 700 having an independent N-well region NW outside the element-forming region. This goes for the eighth preferred embodiment describing the D/A converter 600.

When a plurality of D/A converters are arranged together, such a structure causes no coupling of the parasitic capacitance between the respective N-well regions NW, thereby preventing the generation of signal crosstalk between the D/A converters 700.

However, if the generation of crosstalk is within tolerance, having a common N-well region among a plurality of D/A converters 700 enlarges the area of the N-well region NW, and increases the parasitic capacitance between the N-well region NW and the substrate. This results in an increase in the parasitic capacitance of a low-path filter that is composed of the resistance and the parasitic capacitance between the power supply VDD and the N-well region NW, thereby stabilizing the potential of the N-well region NW.

Figure 24:
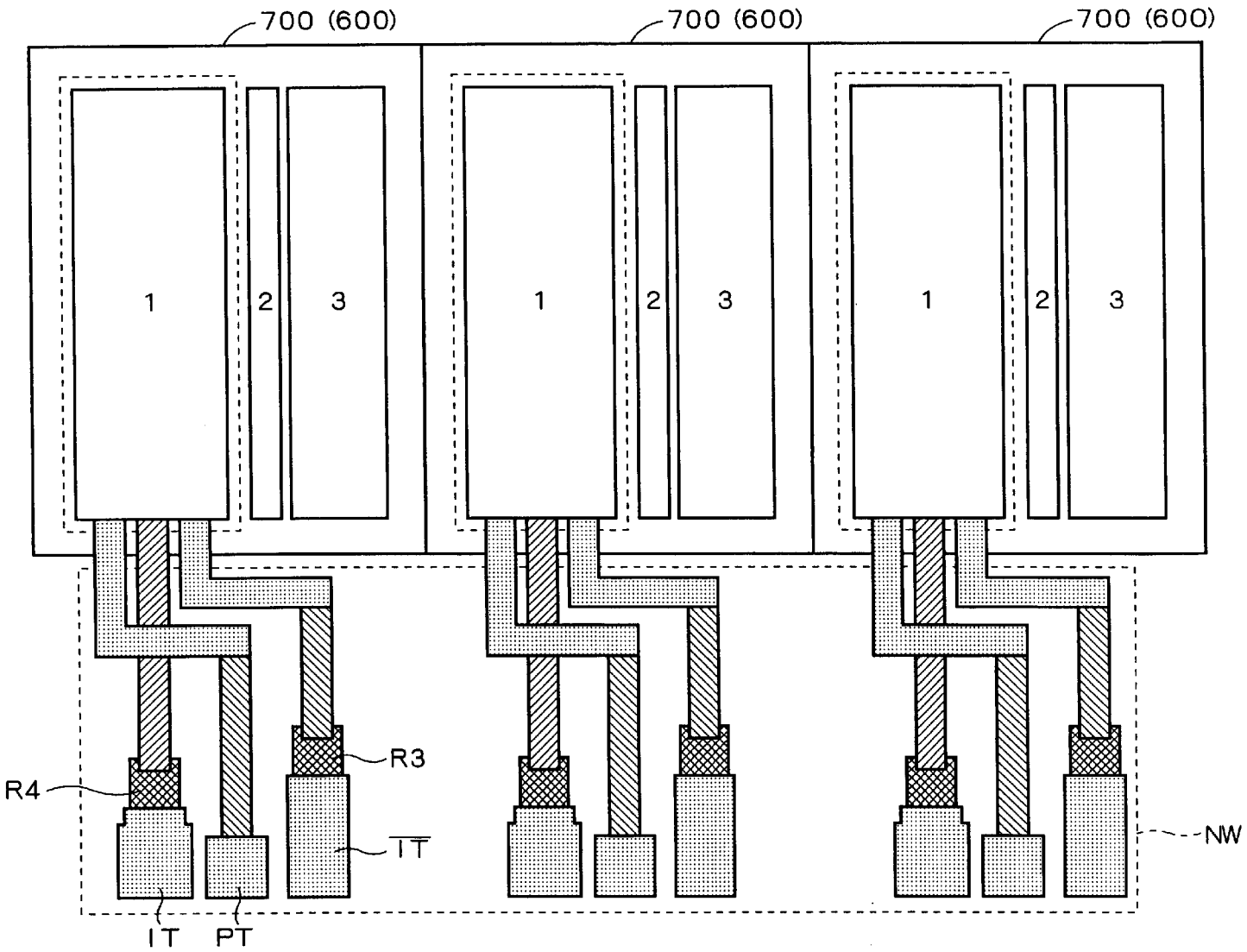
FIG. 24 shows the layout of the D/A converters as a modification of the ninth preferred embodiment.

FIG. 24 shows such a layout that the plurality of D/A converters have one N-well region NW in common.

9-4. Application except to D/A Converter

While the D/A converter is cited as an example in the aforementioned eighth and ninth preferred embodiments, the present invention is not limited thereto, but also applicable, for example, to the output portion of an amplifier with large current output or to the output portion of a buffer.

Figure 25:
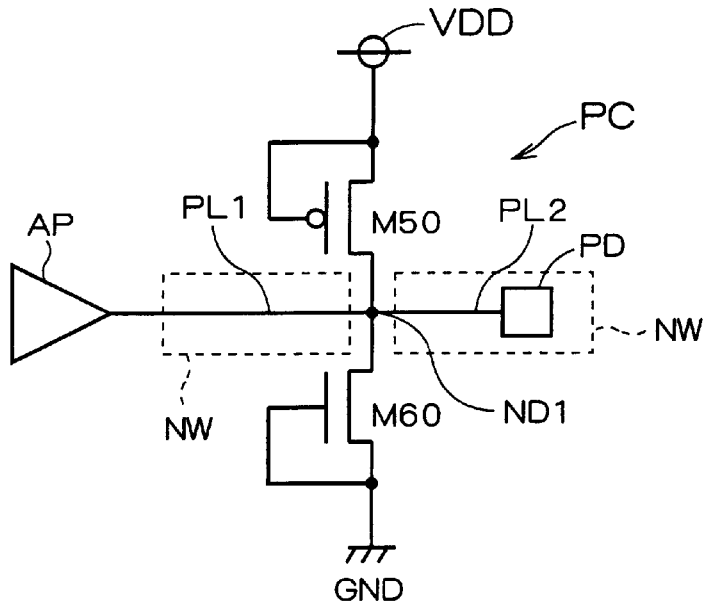
FIGS. 25 and 26 show another examples of the application of the ninth preferred embodiment except to the D/A converter.
Figure 26:
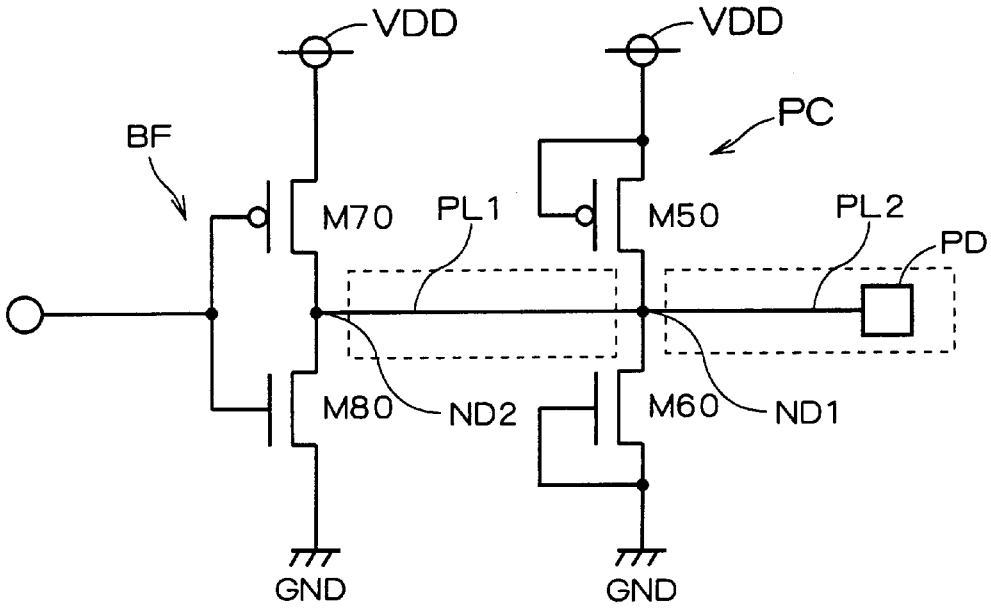

As another examples of the application of the present invention, FIG. 25 shows the output portion of an amplifier, and FIG. 26 shows the output portion of a buffer.

In FIG. 25, a surge protective circuit PC is provided at the output of an amplifier AP, connected at its output to a terminal PD. The surge protective circuit PC is composed of transistors M50 (P-channel MOSFERT) and M60 (N-channel MOSFET) connected in series between the power supply VDD and the ground GND and each having a diode connection. The terminal PD is connected to a connection node ND 1 between the transistors M50 and M60.

In such a structure, a wire PL1 connecting the output of the amplifier AP and the connection node ND1 of the surge protective circuit PC, and a wire PL2 connecting the connection node ND1 of the surge protective circuit PC and the terminal PD, will be formed on the N-well region NW.

In FIG. 26, a surge protective circuit PC is provided at the output of a buffer BF, connected at its output to the terminal PD. Shown as an example of the buffer BF is an inverter circuit composed of transistors M70 (P-channel MOSFET) and M80 (N-channel MOSFET) connected in series between the power potential VDD and the ground GND. The structure of the surge protective circuit PC is similar to that in FIG. 25.

In such a structure, the wire PL1 connecting the output of the buffer BF, namely, a connection node ND2 between the transistors M70 and M80, and the connection node ND1 of the surge protective circuit PC, and the wire PL2 connecting the connection node ND1 of the surge protective circuit PC and the terminal PD, will be formed on the N-well region.

Further, to fix the potential of the N-well region NW, the power supply needs to be connected to the N-well region NW. A general method will do for this, such as connecting the power terminal and the N-well region by the contact hole.

As described so far, when the semiconductor integrated circuit device has a large current output and the possibility of generating the ringing at its output due to the parasitic capacitance and the parasitic inductance, if the device has a current path provided in a region except the element-forming region where the element to specify the operation of the device is formed, the parasitic resistance on the conductive layer forming the current path can be reduced by locating the current path above the well region that is formed within the surface of the semiconductor substrate and electrically connected to the operating source of the semiconductor integrated circuit device.

9-5. Output Terminal Arrangement

In the D/A converter 700 of the ninth preferred embodiment, the power terminal PT is provided at the center, and the output terminals IT and $\overline{\text{IT}}$ are provided at each side of the power terminal PT. This goes for the D/A converter 600 of the eighth preferred embodiment. We will now describe that reason, referring to FIG. 27.

As previously described referring to FIG. 32, the parasitic inductance L1 to L3 are parasitic to the power terminal PT and the output terminals IT and $\overline{\text{IT}}$, respectively. At the parasitic inductance, potential is generated instantaneously by displacement of current output at the output of the D/A converter. As a result, mutual inductance between the adjacent terminals will give an adverse effect on each terminal.

Figure 27:
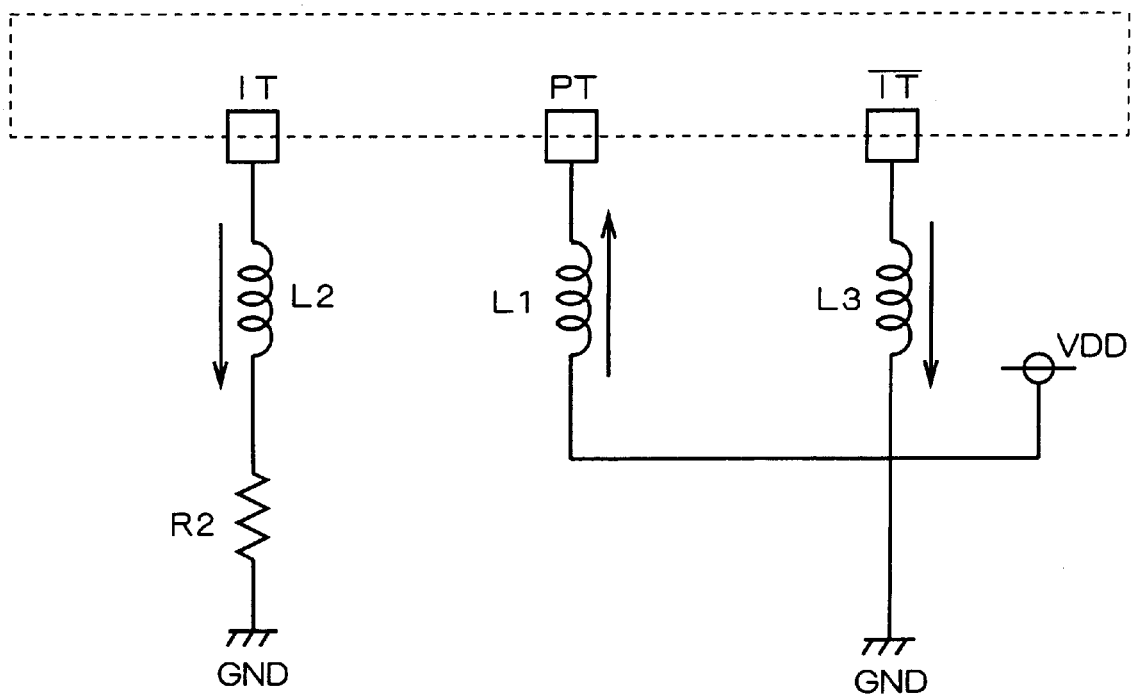
FIG. 27 illustrates the effect of the arrangement of terminals in the D/A converter.

FIG. 27 schematically shows the arrangement of the terminals shown in FIG. 14, where arrows indicate the directions of current flowing through the terminals. As shown in FIG. 27, the power terminal PT, the current flow of which is opposite to that of the output terminals IT and $\overline{\text{IT}}$, is provided at the center among the terminals. Thus, the flow of current through one terminal becomes opposite to that through the adjacent terminals. This allows the mutual inductance between the adjacent terminals to reduce the influence of self inductance at each terminal.

While the MOSFET is used as the transistor in the aforementioned first to ninth preferred embodiments, the present invention is not limited thereto, but also applicable to a bipolar transistor.

10. Tenth Preferred Embodiment

The aforementioned first to ninth preferred embodiments have mainly focused on the D/A converter to reduce its output ringing. The present invention is, however, not limited thereto, but also applicable to various semiconductor integrated circuit devices having the current generator which is composed of the current-source transistor and the switching transistors.

While reducing its output ringing is one of the subjects in the semiconductor integrated circuit device with such a current generator, another subject is to prevent the application of surge voltage to the current-source transistor via a bias-signal line.

10-1. Device Structure

Figure 28:
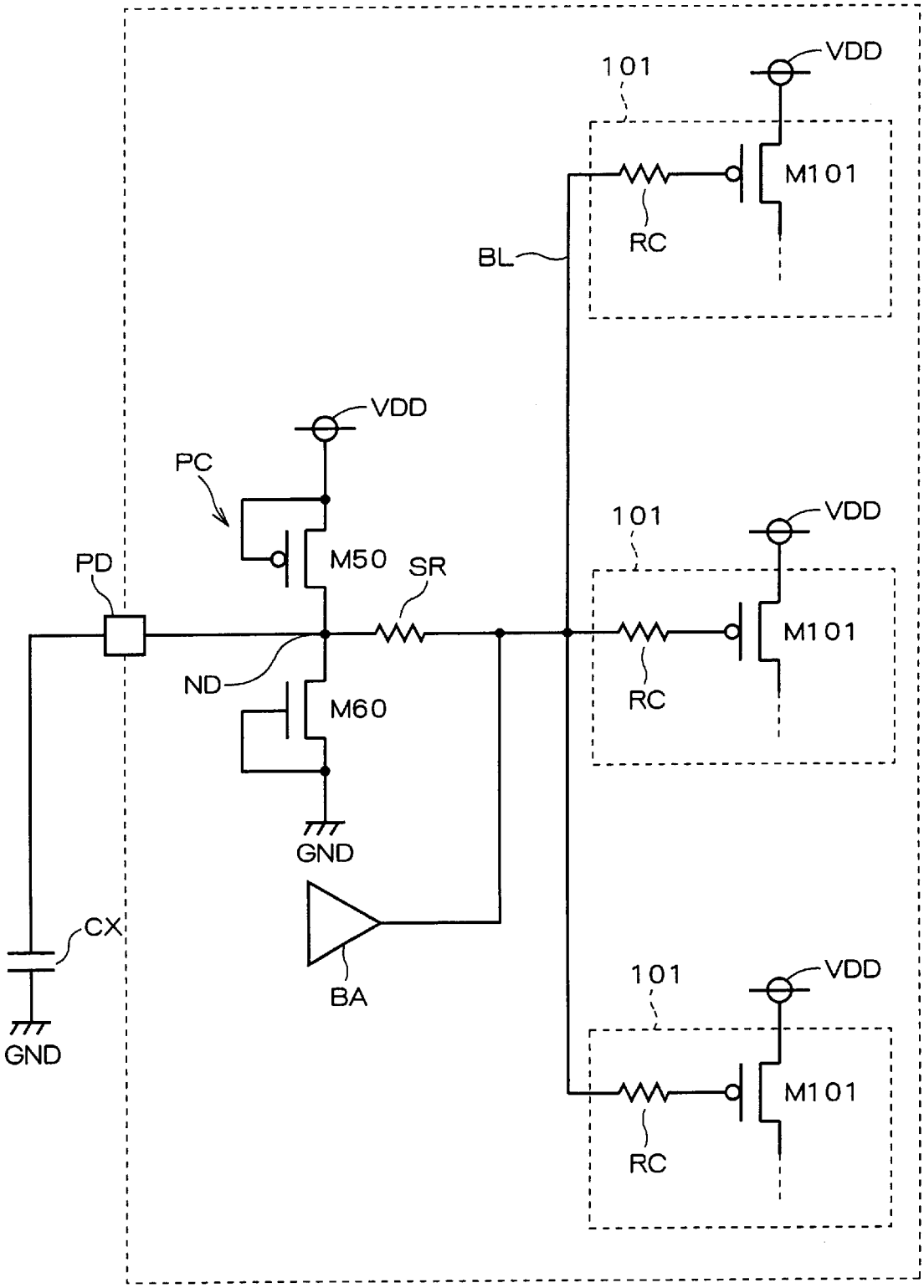
FIG. 28 PRIOR ART
FIG. 28 shows a conventional structure to prevent the application of a surge voltage to a power source.

FIG. 28 shows a conventional structure to prevent the application of the surge voltage. The drawing includes a plurality of current generators 101 each having current-source transistors M101 (P-channel MOSFET), and the structure to apply the bias signal to those current generators.

As shown, each of the current-source transistors M101 is connected at its gate electrode to a bias-signal line BL via a crosstalk preventive resistance RC. The bias-signal line BL is connected to a bias amplifier BA, and also to a terminal PD via a surge protective resistance SR and the surge protective circuit PC. The terminal PD is connected to an external regulation capacitance CX for controlling fluctuations of the signal on the bias-signal line BL.

The surge protective circuit PC is composed of the transistors M50 (P-channel MOSFET) and M60 (N-channel MOSFET), connected in series between the power supply VDD and the ground GND and each having a diode connection. The terminal PD and the surge protective resistance SR are connected to a connection node ND between the transistors M50 and M60.

In this fashion, the conventional structure has prevented the application of the surge voltage by locating the surge protective resistance SR and the surge protective circuit PC on the bias-signal line BL. In such a structure, however, the surge protective resistance SR functions as common impedance to propagate its voltage oscillation to all the current-source transistors M101. On the contrary, when voltage oscillation generated at one current-source transistor M101 is transmitted to the surge protective resistance SR, that oscillation will be transmitted to all of the other current-source transistors M101.

Figure 29:
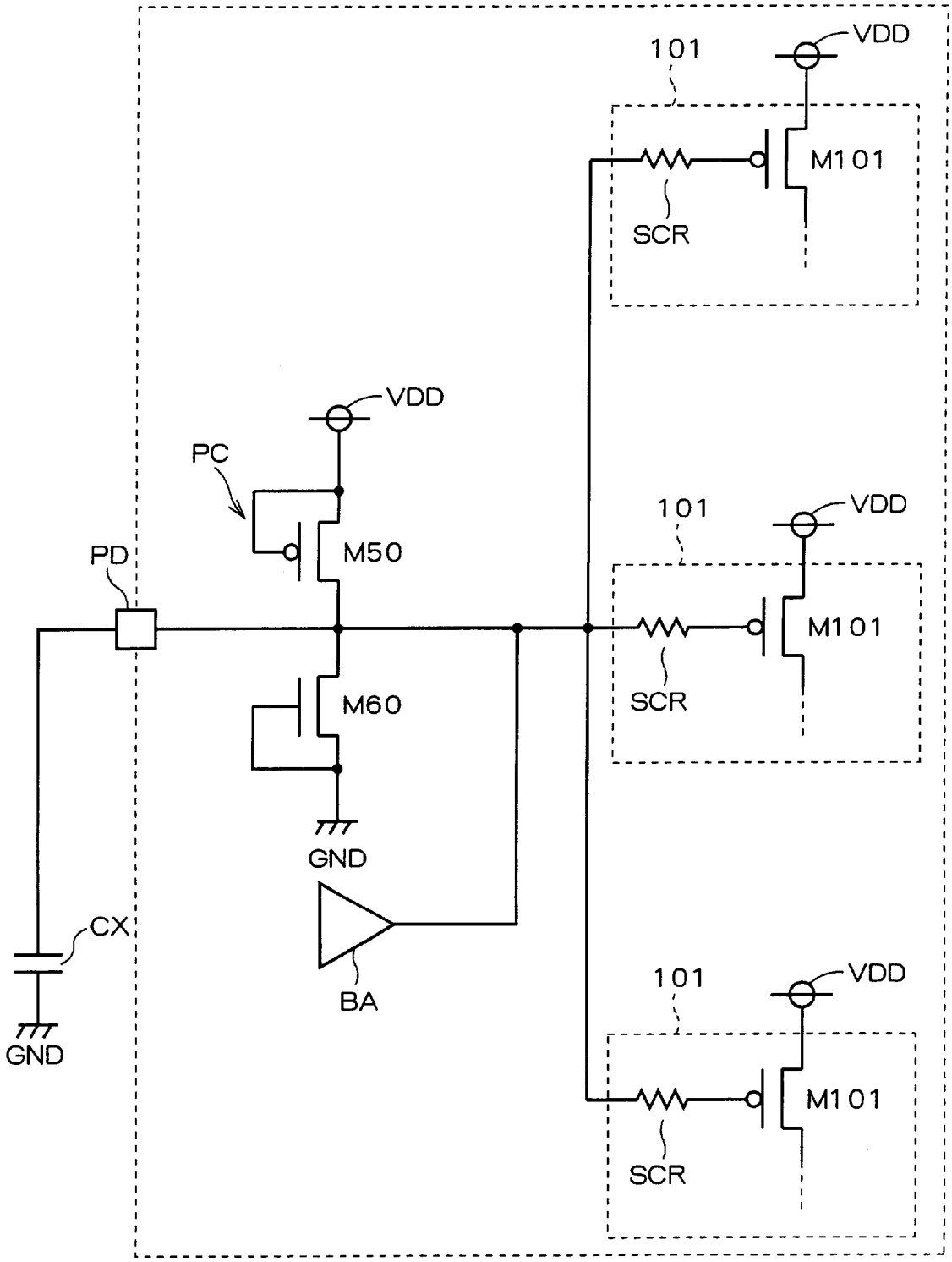
FIG. 29 shows a structure according to a tenth preferred embodiment of the present invention.
Figure 30:
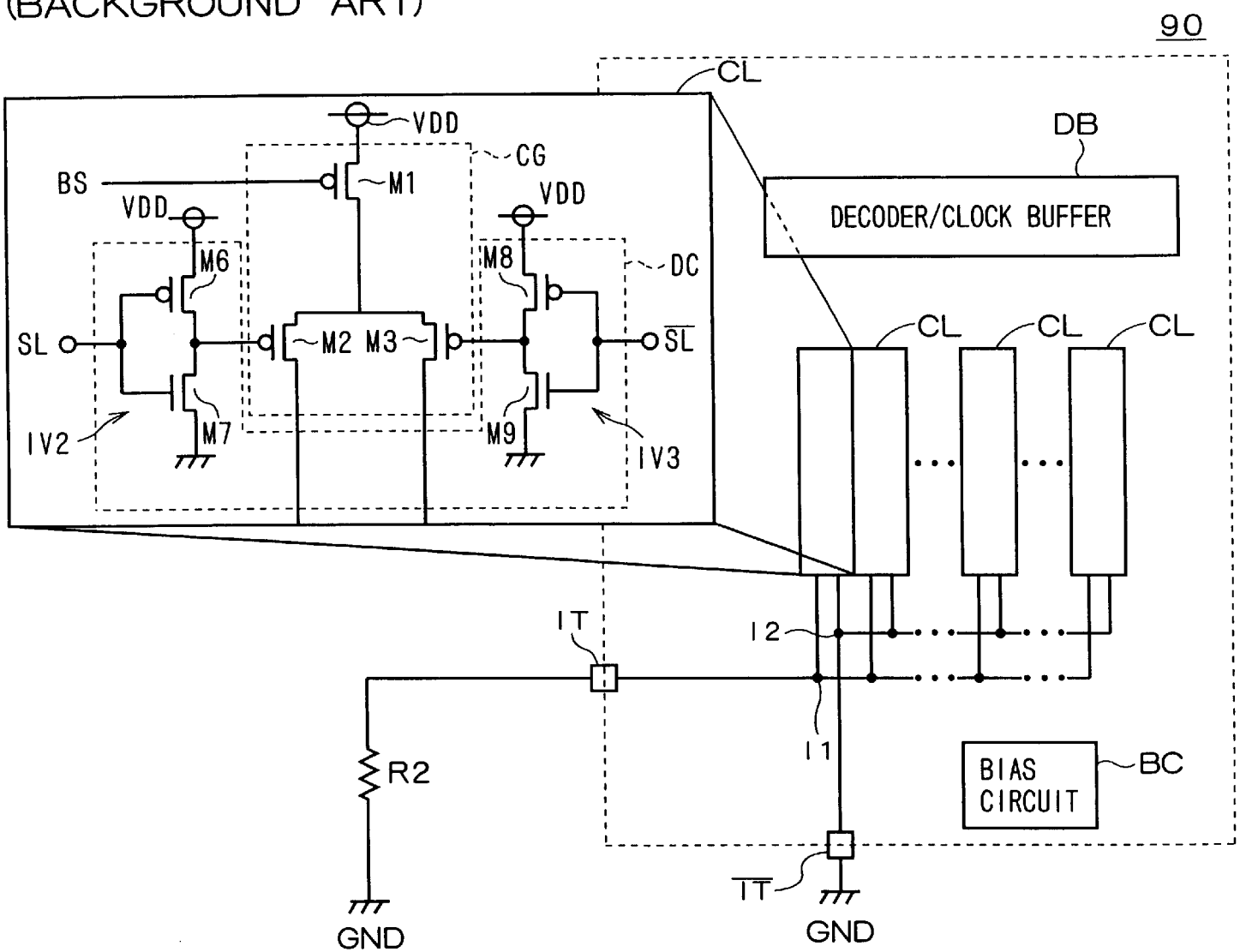
FIG. 30 (BACKGROUND ART)
FIG. 30 shows an overall structure of the conventional D/A converter.
Figure 31:
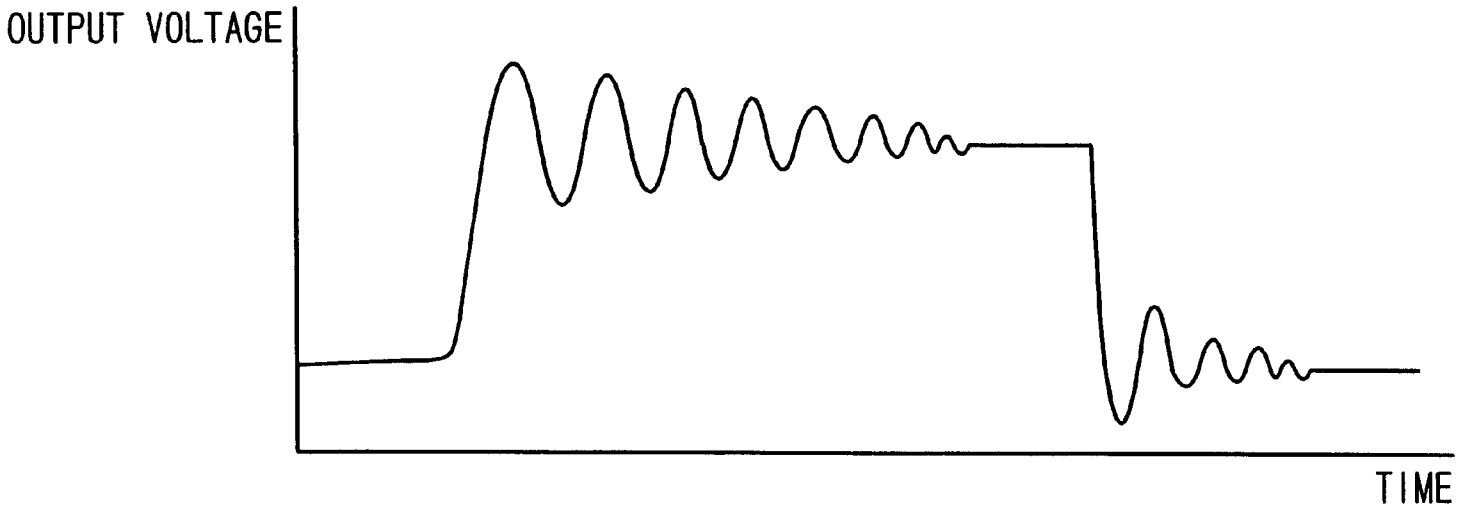
FIG. 31 (BACKGROUND ART)
FIG. 31 shows the output waveform of the conventional D/A converter.

To resolve such a problem, the inventors has found it to provide the surge protective resistance for each current generator 101 and to use the same resistance also as a crosstalk preventive resistance so as not to enlarge the device. FIG. 29 shows this structure. In FIG. 29, similar components as those in FIG. 28 are denoted by the same reference numerals and characters to simplify the description.

As shown in FIG. 29, each of the current-source transistors M101 is connected at its gate electrode to the bias-signal line BL via a surge/crosstalk preventive resistance SCR.

Since the surge protective resistance has a greater line width than the crosstalk preventive resistance to resist a larger voltage, the line width of the surge/crosstalk preventive resistance SCR, which functions both as the surge protective resistance and the crosstalk preventive resistance, is set to be about the same as that of the surge protective resistance.

With respect to the plan form of the surge/crosstalk preventive resistance, it may be long and narrow in constant line width. However, having a great line width, the surge/crosstalk preventive resistance will require a large area to obtain a predetermined resistance value. Thus, from the viewpoint of downsizing of the device, the line width of the surge/crosstalk preventive resistance SCR may be made large on the application side of the surge voltage and made about the same as that of the conventional crosstalk preventive resistance on the side of the current-source transistor M101.

Obviously, the current-source transistor M101 may be an N-channel MOSFET, instead of the P-channel MOSFET as described above.

10-2. Characteristic Function and Effect

With such a structure, it becomes possible to prevent the damage to the current-source transistor M101 by the application of the surge voltage, and the crosstalk between the current generators 101. Further, it becomes possible to prevent fluctuations of the gate potential of the current-source transistor M101 in one current generator 101 from being propagated to other current-source transistors M101 in the other current generators 101.

While the invention has been described in detail, the foregoing description is in all aspects illustrative and not restrictive. It is understood that numerous other modifications and variations can be devised without departing from the scope of the invention.

We claim:

1. A semiconductor integrated circuit device comprising:

a constant current source directly connected to a first power supply via a power terminal;

first and second current switches connected to an end of said constant current source in parallel with each other, and configured to output first and second outputs complementarily on the basis of first and second control signals that are complementarily applied from a driving means;

a first terminal electrically connected to a first end of said first current switch opposite from the end thereof connected to said constant current source, and configured to output said first output to the outside as the output of said semiconductor integrated circuit;

a second terminal electrically connected to a second end of said second current switch opposite from the end thereof connected to said constant current source, and configured to output said second output to the outside as the output of said semiconductor integrated circuit;

first resistive elements, a first of which is connected in a first path between said first end of said first current switch and said first terminal and a second of which is connected in a second path between said second end of said second current switch and said second terminal; and a resistive element connected in a third path between said first terminal and a second power supply; and wherein said second terminal is directly connected to said second power supply.

2. The semiconductor integrated circuit device according to claim 1, wherein:

said constant current source, said first current switch, and said second current switch are first to third transistors of a first conductivity type, respectively, said first transistor connected at its first main electrode to said power terminal and at its second main electrode to respective first main electrodes of said second and said third transistors, said second transistor and said third transistor connected at their second main electrodes to said first path and said second path, respectively; and said driving means comprises:

a first inverter circuit having a fourth transistor of the first conductivity type that is connected at its first main electrode to said first power supply, and a fifth transistor of a second conductivity type that is connected at its first main electrode to said second power supply and at its second main electrode to a second main electrode of said fourth transistor, said first inverter circuit inverting a first signal that is applied at respective control electrodes of said fourth and said fifth transistors, and outputting the inverted first signal as said first control signal from a connected portion between said second main electrodes of said fourth and said fifth transistors, said connected portion being an output portion;

a second inverter circuit having a sixth transistor of the first conductivity type that is connected at its first main electrode to said first power supply, and a seventh transistor of the second conductivity type that is connected at its first main electrode to said second power supply and at its second main electrode to a second main electrode of said sixth transistor, said second inverter circuit inverting a second signal that is applied at respective control electrodes of said sixth and said seventh transistors, and outputting the inverted second signal as said second control signal from a connected portion between said second main electrodes of said sixth and said seventh transistors, said connected portion being an output portion; and a second resistive element electrically connected between said output portions of said first and said second inverter circuits.

3. The semiconductor integrated circuit device according to claim 2, wherein:

said second resistive element is a resistance.

4. The semiconductor integrated circuit device according to claim 2, wherein:

said second resistive element is composed of:

an eighth transistor having a first main electrode connected to said first inverter circuit, a second main electrode connected to said second inverter circuit, and a control electrode having a diode connection; and a ninth transistor having a first main electrode connected to said second inverter circuit, a second main electrode connected to said first inverter circuit, and a control electrode having a diode connection.

5. The semiconductor integrated circuit device according to claim 4, wherein:

said driving means further comprises:

first cutoff means provided between said second main electrode of said eighth transistor and said output portion of said second inverter circuit, said first cutoff means receiving a cutoff signal and cutting off a path that electrically connects said second main electrode of said eighth transistor and said output portion of said second inverter circuit; and second cutoff means provided between said second main electrode of said ninth transistor and said output portion of said first inverter circuit, said second cutoff means receiving said cutoff signal and cutting off a path that electrically connects said second main electrode of said ninth transistor and said output portion of said first inverter circuit.

6. The semiconductor integrated circuit device according to claim 5, wherein:

said first cutoff means and said second cutoff means are tenth and eleventh transistors, respectively; and said cutoff signal is applied to respective control electrodes of said tenth and said eleventh transistors.

7. A semiconductor integrated circuit device comprising:

a current generator including a transistor for outputting current in response to a bias signal applied at its control electrode, and a resistance connected at its one end to said control electrode of said transistor;

bias-signal supply means for supplying said bias signal via a bias-signal line connected to the other end of said resistance; and a capacitor provided between said bias-signal line and a predetermined power supply, wherein a line width of said resistance is set wide enough to be resistant to a surge voltage to be applied from said predetermined power supply side via said capacitor.

* * * * *